US010238153B2

(12) United States Patent
Alva

(10) Patent No.: US 10,238,153 B2
(45) Date of Patent: Mar. 26, 2019

(54) GARMENTS FOR A NURSING WOMAN

(71) Applicant: Rumina Nursingwear, Marina, CA (US)

(72) Inventor: Dawn Michele Alva, Marina, CA (US)

(73) Assignee: Rumina Nursingwear, Marina, CA (US)

( * ) Notice: Subject to any disclaimer, the term of this patent is extended or adjusted under 35 U.S.C. 154(b) by 271 days.

(21) Appl. No.: 15/197,334

(22) Filed: Jun. 29, 2016

(65) Prior Publication Data

US 2018/0000168 A1 Jan. 4, 2018

(51) Int. Cl.
*A41C 3/04* (2006.01)
*A41D 1/215* (2018.01)

(52) U.S. Cl.
CPC ..... *A41C 3/04* (2013.01); *A41D 1/215* (2018.01)

(58) Field of Classification Search
CPC ..... A41C 3/04; A41D 1/215
USPC ..... 450/36, 57, 58, 89; 2/104
See application file for complete search history.

(56) References Cited

U.S. PATENT DOCUMENTS

| | | | |
|---|---|---|---|
| 155,720 | A | 10/1874 | Gray et al. |
| 238,945 | A | 3/1881 | Marks |
| 277,744 | A | 5/1883 | Kimball |
| 614,068 | A | 11/1898 | Wetzler |
| 684,078 | A | 10/1901 | Martin |
| 686,699 | A | 11/1901 | Bandler |
| 949,414 | A | 2/1910 | Cunningham |
| 1,136,727 | A | 4/1915 | Smith |
| 1,189,589 | A | 7/1916 | Lawrence |
| 1,371,841 | A | 3/1921 | Berkwits |
| 1,509,226 | A | 9/1924 | Brown |
| 1,670,610 | A | 5/1928 | Colby |
| 1,849,514 | A | 3/1932 | Edelmann |
| 2,075,656 | A | 3/1937 | Paternayan |
| 2,236,142 | A | 3/1941 | Kaupp |
| 2,298,361 | A | 10/1942 | Freund |
| 2,436,430 | A | 2/1948 | Hart |
| 2,440,466 | A | 4/1948 | Freedman |

(Continued)

FOREIGN PATENT DOCUMENTS

| | | | |
|---|---|---|---|
| AU | 2006200947 | A1 | 9/2006 |
| DE | 584456 | C | 9/1933 |

(Continued)

OTHER PUBLICATIONS

Decker, C., "Hands-free Breast Pumping Tip," babylovesyourmilk.com, (last modified Jun. 4, 2010), http://babylovesyourmilk.com/hands-free-breast-pumping.php, 4 pages.

(Continued)

*Primary Examiner* — Gloria Hale
(74) *Attorney, Agent, or Firm* — TraskBritt

(57) ABSTRACT

Garments for a nursing woman, which garments may be configured to enable hands-free breast pumping using a breast pump, include a brassiere portion with a plurality of at least partially overlapping material layers, which may be defined, in whole or in part, by edges that are at least substantially straight. The funnel of the breast pump may be received under and behind edges of the layers, and the edges may provide support to the funnel while the breast pump is used for milk expression.

20 Claims, 19 Drawing Sheets

(56) References Cited

U.S. PATENT DOCUMENTS 2,452,345 A 10/1948 Anselmo
2,485,313 A 10/1949 Rabinowitz
2,486,836 A 11/1949 Garson
2,492,862 A 12/1949 Harvey
2,498,487 A 2/1950 Elias
2,501,860 A 3/1950 Becker
2,585,338 A 2/1952 Meares
2,611,130 A 9/1952 Engelman
2,613,355 A 10/1952 Coleman
D170,509 S 9/1953 Peck
2,679,048 A 5/1954 Alberts
2,711,539 A 6/1955 Loscher
2,715,225 A 8/1955 Gould
2,890,702 A 6/1959 Farino
2,925,816 A 2/1960 Rosenthal
2,928,396 A 3/1960 O'Dell
3,002,515 A 10/1961 Glogover
3,145,714 A 8/1964 Brown
3,306,299 A 2/1967 Paramore
3,516,415 A 6/1970 Hadley-Webb
3,524,449 A 8/1970 Peters
3,746,007 A 7/1973 Hand et al.
3,746,008 A 7/1973 LoCascio et al.
3,763,865 A 10/1973 DeFru
3,773,052 A 11/1973 Belardinelli
3,780,741 A 12/1973 Cole
3,782,385 A 1/1974 Loyd
3,834,397 A 9/1974 Birch
3,840,012 A 10/1974 Rushton, Jr.
3,890,978 A 6/1975 Nobbs
3,931,816 A 1/1976 Waldmann
4,004,294 A 1/1977 Pinch
4,263,912 A 4/1981 Adams
4,270,538 A 6/1981 Murphy
4,335,728 A 6/1982 Fildan
4,355,641 A 10/1982 Dastoli et al.
4,390,024 A 6/1983 Williams
4,393,875 A 7/1983 O'Boyle et al.
4,411,269 A 10/1983 Weintraub
4,423,734 A 1/1984 Schawel
4,453,549 A 6/1984 DiTullio
4,550,734 A 11/1985 Porco
4,584,992 A 4/1986 Liu
4,633,876 A 1/1987 Scullin
4,640,287 A 2/1987 Anderson et al.
4,673,388 A 6/1987 Schlensog et al.
4,697,592 A 10/1987 Maddux et al.
4,713,842 A 12/1987 Patterson
4,857,051 A 8/1989 Larsson
4,878,879 A 11/1989 Kunstadter
4,892,517 A 1/1990 Yuan et al.
4,911,677 A 3/1990 White
4,929,229 A 5/1990 Larsson
4,956,878 A 9/1990 Boynton
5,009,638 A 4/1991 Riedweg et al.
5,024,628 A 6/1991 Sanchez
5,032,104 A 7/1991 Rainville
5,038,411 A 8/1991 St. Armand
5,045,019 A 9/1991 Capasso et al.
5,049,126 A 9/1991 Larsson
D321,273 S 11/1991 Hull
5,071,403 A 12/1991 Larsson
5,090,059 A 2/1992 Kahl
5,092,812 A 3/1992 Babcock
5,094,647 A 3/1992 Courtney
5,167,566 A 12/1992 Novitsky et al.
5,180,326 A 1/1993 Williams
5,278,998 A 1/1994 Book
5,295,957 A 3/1994 Aida et al.
5,309,572 A 5/1994 Seamans
5,358,476 A 10/1994 Wilson
5,380,238 A 1/1995 Crew-Gee
5,415,632 A 5/1995 Samson
D366,351 S 1/1996 Winchell
5,514,166 A 5/1996 Silver et al.
5,571,084 A 11/1996 Palmer
5,575,768 A 11/1996 Lockridge et al.
5,616,125 A 4/1997 Jelks
5,660,577 A 8/1997 Modena
5,664,257 A 9/1997 Hall
5,697,830 A 12/1997 White
5,720,722 A 2/1998 Lockridge
5,823,851 A 10/1998 Dicker
5,941,847 A 8/1999 Huber et al.
5,954,690 A 9/1999 Larsson
6,004,186 A 12/1999 Penny
6,027,396 A 2/2000 Yonchar
6,083,079 A 7/2000 Pearson
6,178,784 B1 1/2001 Marley, Jr.
6,213,840 B1 4/2001 Han
6,227,936 B1 5/2001 Mendoza
6,247,996 B1 6/2001 Fields
D446,629 S 8/2001 Swanger
6,346,027 B1 2/2002 Merkovsky
6,364,741 B1 4/2002 Ferguson
6,379,327 B2 4/2002 Lundy
6,440,100 B1 8/2002 Prentiss
6,575,202 B2 6/2003 Lafond
6,652,484 B1 11/2003 Hunckler et al.
6,659,841 B2 12/2003 Raimondo
6,706,012 B2 3/2004 McKendry et al.
6,764,377 B2 7/2004 Gillan
6,821,185 B1 11/2004 Francis
6,854,132 B1 2/2005 Polzin
6,855,029 B2 2/2005 Rothman
6,866,558 B2 3/2005 Luciano et al.
6,887,217 B1 5/2005 Logan
6,896,581 B2 5/2005 Otto
6,974,361 B2 12/2005 Cravaack et al.
6,983,489 B2 1/2006 Caprio
7,076,809 B2 7/2006 Rothman
7,081,034 B1 7/2006 Zoellner
7,094,217 B2 8/2006 Fialkoff
7,128,877 B2 10/2006 Quay et al.
7,223,255 B2 5/2007 Myers et al.
7,306,505 B2 * 12/2007 Barbour ..... A41C 3/0057 2/DIG. 2
7,435,155 B2 10/2008 Reinisch et al.
7,448,936 B1 11/2008 Kemp-Dorsey
7,559,915 B2 7/2009 Dao et al.
7,695,343 B2 4/2010 Nobbs
8,137,153 B2 3/2012 Bell
8,192,247 B2 6/2012 Abbaszadeh
8,307,463 B2 11/2012 Ritchie
8,323,070 B2 12/2012 Abbaszadeh
8,414,353 B1 4/2013 Leavell
8,469,769 B2 6/2013 Hendrickson
8,469,770 B2 * 6/2013 Alva ..... A41C 3/04 450/30
8,657,643 B2 2/2014 Perez
8,668,547 B2 3/2014 Boonen et al.
9,155,339 B2 * 10/2015 Alva ..... A41C 3/04
9,629,396 B2 * 4/2017 Alva ..... A41C 3/04
2002/0022433 A1 2/2002 Yeung et al.
2002/0193731 A1 12/2002 Myers et al.
2003/0167037 A1 9/2003 Fialkoff
2003/0186617 A1 10/2003 Soerensen
2003/0191427 A1 10/2003 Jay et al.
2005/0159701 A1 7/2005 Conaway
2005/0198726 A1 9/2005 Yadav et al.
2006/0111664 A1 5/2006 Samson et al.
2007/0161330 A1 7/2007 Whitehead et al.
2007/0271675 A1 11/2007 Eraca
2008/0039781 A1 2/2008 Bjorge
2008/0064299 A1 3/2008 La Fontaine
2009/0265830 A1 10/2009 Hendrickson
2010/0159802 A1 6/2010 Abbaszadeh
2011/0092134 A1 * 4/2011 Alva ..... A41C 3/04 450/36
2011/0239702 A1 10/2011 Best et al.
2011/0281497 A1 11/2011 Van Dorp et al.
2011/0314587 A1 12/2011 Ritchie
2012/0129427 A1 5/2012 Perez
2012/0184179 A1 7/2012 Blitz

(56) References Cited

U.S. PATENT DOCUMENTS

| | | | |
|---|---|---|---|
| 2012/0185992 | A1 | 7/2012 | Byrnes |
| 2012/0197187 | A1 | 8/2012 | LaFave |
| 2012/0277636 | A1 | 11/2012 | Blondheim et al. |
| 2012/0309264 | A1 | 12/2012 | Kubik |
| 2013/0095727 | A1 | 4/2013 | Abbaszadeh |
| 2013/0122780 | A1 | 5/2013 | McCall |
| 2014/0220860 | A1 | 8/2014 | Alva |
| 2014/0364035 | A1 | 12/2014 | Abbaszadeh |
| 2014/0364036 | A1 | 12/2014 | Abbaszadeh |
| 2015/0133028 | A1 | 5/2015 | Applewhite |
| 2015/0143605 | A1 | 5/2015 | Cobb |
| 2016/0007659 | A1 | 1/2016 | Blacker |
| 2016/0015092 | A1 | 1/2016 | Abbaszadeh |

FOREIGN PATENT DOCUMENTS

| | | | |
|---|---|---|---|
| EP | 752213 | A1 | 1/1997 |
| EP | 941674 | A1 | 9/1999 |
| FR | 1004058 | A | 3/1952 |
| GB | 2287640 | A | 9/1995 |
| WO | 9953780 | A1 | 10/1999 |
| WO | 2009134274 | A1 | 11/2009 |
| WO | 2010070042 | A1 | 6/2010 |
| WO | 2010080122 | A1 | 7/2010 |
| WO | 2012172437 | A2 | 12/2012 |
| WO | 2013/180644 | A1 | 12/2013 |

OTHER PUBLICATIONS

"Nourish by BeliBea," Belibea, http://web.archive.org/web/20150121222132/http://belibea.com/producl/nourish-by-belibea/, (archived Jan. 21, 2015), 2 pages.

* cited by examiner

GARMENTS FOR A NURSING WOMAN

TECHNICAL FIELD

The present disclosure, in various embodiments, relates generally to apparel worn by a nursing woman. More particularly, this disclosure relates to a garment configured to accommodate a woman's use of a breast pump.

BACKGROUND

Because of the increased awareness of the health benefits of breastfeeding for both infant and mother, many women are finding ways to provide their infants with breast milk even if the mothers are not physically present during the delivery of the milk to the infants or not physically able to directly breastfeed their infants. To do this, typically, a woman will express milk using a manual or electric breast pump device that has a funnel. The funnel is placed over the nipple of the breast, and suction is applied by the breast pump to encourage expression of milk from the nipple. A conventional electronic breast pump includes the funnel, a motor to generate the suction for the expression of milk, and a reservoir connected to the funnel to receive the expressed milk. Because of the duration and frequency required for breast milk expression, a woman may express both breasts simultaneously to increase efficiency. This process is often uncomfortable and time consuming. Further, without additional support, the funnel of a conventional breast pump often will not remain over the nipple on the breast; therefore, use of the pump often inhibits the woman from concurrently performing other activities.

Efforts have been made to design brassieres, or other garments, that may be configured for use with a breast pump, which brassieres or other garments are referred to herein as "pumping brassieres" or "pumping garments," respectively. These designs are often uncomfortable and cumbersome for the nursing woman. Often, the conventional pumping garments include various attachments to secure the funnel of the breast pump to the wearer's breast. For example, elastic bands, slings, hooks, buttons, and the like may be used. Some conventional pumping garments require additional devices or fabric pieces to be added or detached before the funnel can be secured. For example, U.S. Pat. No. 7,094,217, issued Aug. 22, 2006, describes the use of an elastic band to secure the funnel of the pump and the use of a latch to secure portions of the pumping brassiere when the wearer is not expressing milk.

Many conventional pumping garments are not designed to be worn for an extended length of time, but rather, essentially only while the wearer is expressing milk. Often, donning such pumping garments or attaching breast pumps, for the time of nursing, requires at least partially disrobing or at least partial exposure of the breast. For example, U.S. Pat. No. 6,004,186, issued Dec. 21, 1999, describes a garment (e.g., a halter top, a bandeau, a tube top) that the woman wears to secure a funnel of a breast pump to her breast. Breast pump funnels may be inserted into two openings in a central area of each side of the garment.

Conventional pumping brassieres also may not be configured to accommodate attachment and detachment of breast pump funnels while the woman is wearing the brassiere, may not accommodate or support the natural expansion and contraction of a nursing woman's breasts, and may not be designed to accommodate both direct nursing of an infant and pumping of breast milk with a breast pump.

Further, conventional pumping garments are also often constructed from several pieces of fabric cut in accordance with an intricately shaped pattern. For example, material may be cut into fabric pieces with curved or partially curved edges to achieve a constructed pumping garment that conforms to the shape of the nursing woman's breasts. However, the intricately shaped pattern often leads to a substantial amount of wasted fabric.

BRIEF SUMMARY

A garment for a nursing woman, according to at least one embodiment of the present disclosure, comprises front brassiere portion. The front brassiere portion comprises a plurality of at least partially overlapping material layers. The plurality of at least partially overlapping material layers comprises a first material layer, a second material layer, and a third material layer. The first material layer extends from an upper peripheral edge of the front brassiere portion toward a lower peripheral edge of the front brassiere portion. The second material layer extends from the lower peripheral edge of the front brassiere portion toward the upper peripheral edge of the front brassiere portion. The third material layer extends from a lateral peripheral edge of the front brassiere portion toward a medial centerline of the front brassiere portion.

Also disclosed is a garment comprising a pair of brassiere cups. At least one brassiere cup of the pair comprises a first material layer at least partially overlapping a second material layer and a third material layer. The second material layer and the third material layer at least partially overlap one another. A free edge of the second material layer crosses a free edge of the third material layer to define a nook. The free edge of the third material layer extends vertically from an upper peripheral edge of the brassiere cup to a lower peripheral edge of the brassier cup. The free edge of the second material layer extends horizontally from a lateral side edge of the brassiere cup to a medial side edge of the brassiere cup. The first material layer overlaps the nook.

Further disclosed is a garment for a nursing woman, the garment comprising a brassiere portion comprising a pair of cups. At least one cup of the pair comprises at least partially overlapping material layers defined by substantially straight edges. At least two of the substantially straight edges cross to define a nook at a peripheral edge of the cup.

DETAILED DESCRIPTION

Figure 1:
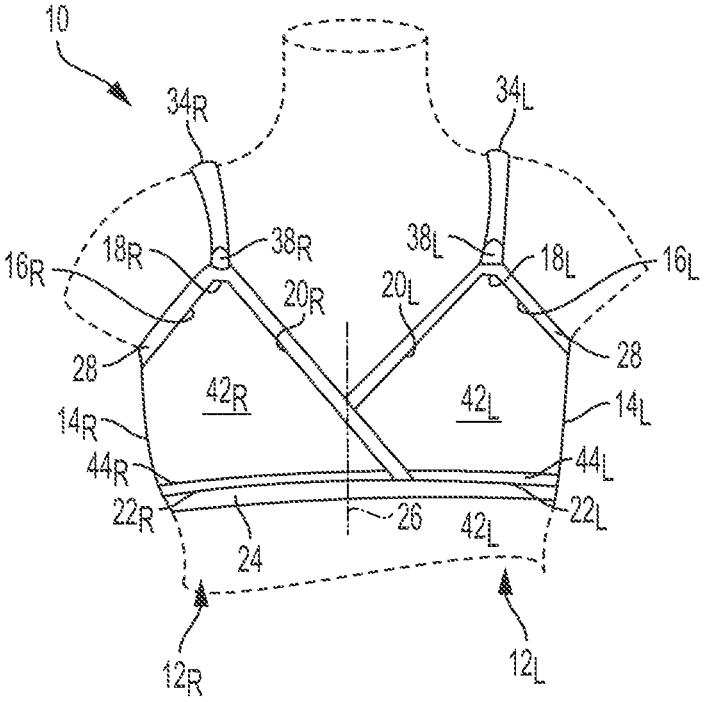
FIG. 1 is a front elevational view of a garment, in the configuration of a brassiere, with a front brassiere portion having brassiere cups according to a first embodiment of the present disclosure.

The illustrations presented herein are not meant to be actual views of any particular garment or component thereof, but are merely idealized representations that are employed to describe embodiments of the present disclosure.

As used herein, the terms "right" and "left," when referring to the garment, or part thereof, or to a wearer, or part thereof, mean the right and left, respectively, from the perspective of the wearer, the garment, or referenced part thereof.

As used herein, the term "lateral" means proximate to a side of a body, the garment, or referenced part thereof.

As used herein, the term "medial" means proximate to the midline of a body or the median axis of the garment or referenced part thereof.

As used herein, the term "vertical" means a direction substantially parallel to the midline of a body or the median axis of the garment.

As used herein, the term "horizontal" means a direction substantially perpendicular to the midline of a body or substantially perpendicular to the median axis of the garment.

As used herein, the term "front brassiere portion" means and refers to the portion of a brassiere that is worn at the wearer's front, between at least under the bust to above the bust and between a left lateral side and a right lateral side of the wearer.

As used herein, the term "substantially straight," when referring to an edge of a layer, means an edge that deviates less than 1 inch (less than 2.54 cm) from a line between the terminal points of the edge when the layer is not being stretched.

As used herein, the term "straight," when referring to an edge of a layer, means an edge that deviates less than 0.25 inches (less than 0.635 cm) from a line between the terminal points of the edge when the layer is not being stretched.

As used herein, the term "disengaged configuration" means and includes a configuration in which components of the garment are positioned in a manner that does not enable engagement of the garment with a breast pump funnel, without moving one or more of the components from the configuration.

As used herein, the term "pumping configuration" means and includes a configuration in which components of the garment are positioned in a manner that enables engagement of the garment with a breast pump funnel.

As used herein, the term "nursing configuration" means and includes a configuration in which components of the garment are positioned in a manner that enables engagement between a breast and a nursing infant As used herein, the term "free edge," when referring to an edge of an identified component or layer, means an edge, of the identified component or layer, that is not affixed along its length to another layer of the garment such that the free edge is configured to be selectively and temporarily moved away from its disengaged configuration without permanently transforming the garment. For example and without limitation, a free edge may include an edge lacking, between its terminal points, any means to secure its length to the other layer. A free edge may also include an edge configured to be selectively unsecured along its length to the other layer, e.g., by a zipper, a hook-and-loop engagement, or the like.

As used herein, the term "attached edge," when referring to an edge of an identified component or layer, means an edge, of the identified component or layer, that is affixed along its length, in whole or in part, to one or more other layers of the garment such that the attached edge cannot be selectively moved from its disengaged configuration without permanently transforming the garment. For example and without limitation, an attached edge may include an edge stitched in whole or in part to secure its length to the one or more other layers. An attached edge may also include an edge glued or otherwise bonded to secure its length to the one or more other layer.

As used herein, the terms "unitary," "singular," and "continuous," when referring to a component or layer, mean and include a component or layer substantially lacking gaps, holes, or other openings defined interior to a periphery of the component or layer and lacking seams that join originally-separate portions or that substantially extend interior to the periphery of the component or layer.

The following description provides specific details, such as material types and attachment points in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional garment assembly techniques employed in the industry.

Garments for use by nursing women are disclosed. The garments include layers of material that at least partially overlap one another. The funnel of a breast pump may be received behind free edges of overlapping layers such that the free edges support the funnel from multiple directions. Thus, a funnel may be received in the garment and supported for hands-free pumping.

In the figures, components of the garment may include left-side components and right-side components. The left-side components are designated by a subscript "L" $X_L$) following the relative reference number, and the right-side components are designated by a subscript "R" (e.g., $X_R$) following the relative reference number. Reference, in the description below, to a component without use of a subscript (e.g., X) is a reference to the component in a manner generic to both the left-side and the right-side component. Reference to a component with the use of a subscript (e.g., $X_L$ or $X_R$) is a reference to the specifically-indicated left-side (e.g., $X_L$) or right-side component (e.g., $X_R$). Therefore, for example, a description of a "brassiere cup 12" is a description that applies to each of a "left-side brassiere cup $\mathbf{12}_L$" and a "right-side brassiere cup $\mathbf{12}_R$," and the "brassiere cup 12" is indicated in the figures as "$\mathbf{12}_L$," with respect to the left side and "$\mathbf{12}_R$," with respect to the right side of the garment.

Also, in the drawings, views of a left-side component may be described as being a mirror view of the corresponding right-side component, and vice versa. Therefore, descriptions of such a left-side component are descriptions of the mirror view of the right-side component.

Figure 2:
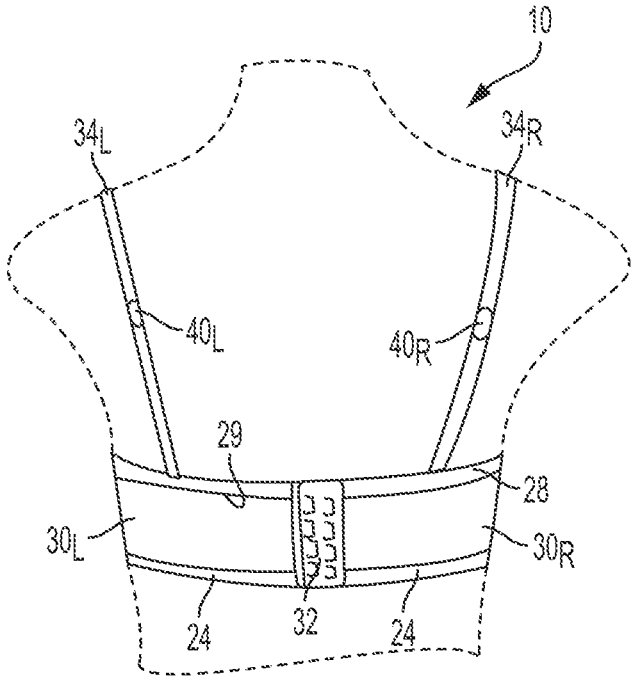
FIG. 2 is a rear elevational view of the brassiere of FIG. 1, with the brassiere cups according to the first embodiment.

FIG. 1 illustrates a front view of a garment, in the configuration of a brassiere 10, according to at least a first embodiment. FIG. 2 illustrates a rear view of the brassiere 10 of FIG. 1. The brassiere 10 may comprise cups (e.g., a left-side cup $12_L$ and a right-side cup $12_R$) each comprising at least partially overlapping layers as described further with reference to FIGS. 3 through 20. As illustrated in FIG. 1, each of the cups 12 may comprise a lateral side edge 14, a lateral upper edge 16 extending from the lateral side edge 14 to a clasp attachment edge 18, and a medial side edge 20 extending from the clasp attachment edge 18 to a lower edge 22.

The lateral side edge 14 may be proximate to an arm of a wearer. The lower edge 22 may extend essentially under a breast of the wearer, extending from one of the lateral side edges 14 to the medial side edge 20 of the respective one of the cups 12. The lower edge 22 may be attached to a rib band 24 extending around the wearer's torso. In some embodiments, the rib band 24 may comprise a stretchable (i.e., elastic) material. In other embodiments, the rib band 24 may comprise underwire, ribbing, or the like. The medial side edges 20 of the cups 12 may overlap (e.g., be arranged to cross over each other) approximately at a medial centerline 26 of the brassiere 10 proximate to a sternum or midline of the wearer. In such embodiments, the brassiere 10 is configured as a criss-cross brassiere. In other embodiments, the medial side edges 20 of the cups 12 may not overlap, but may meet proximate the medial centerline 26 of the brassiere 10.

The lateral side edge 14, the lateral upper edge 16, the clasp attachment edge 18, the medial side edge 20, and the lower edge 22 of the cup 12 define the peripheral edges of the cup 12. Edging 28 may be provided along the lateral upper edge 16, the medial side edge 20, and, optionally, the clasp attachment edge 18 to add to the aesthetics of the brassiere 10 and the comfort of the wearer. The lateral side edges 14 of the cups 12 may be attached to adjustable back bands 30 extending at least partially around the wearer's torso. Edging 28 may be provided and extend along a length of an upper peripheral edge 29 of the adjustable back band 30 to add to the aesthetics of the brassiere 10 and the comfort of the wearer. In some embodiments, the adjustable back band 30 may comprise a closure mechanism, such as hook-and-eye back closures 32, a zipper, lacing, or the like, to secure the brassiere 10 around the wearer. In other embodiments, the adjustable back band 30 may lack hook-and-eye back closures 32, or other closure mechanism, and may comprise an elastic material configured to secure the brassiere 10 around the wearer. The cups 12 may be attached, or attachable, to shoulder straps 34 (e.g., the left-side cup $12_L$ may be attached, or attachable, to a left-side shoulder strap $34_L$, and the right-side cup $12_R$ may be attached, or attachable, to a right-side shoulder strap $34_R$). The shoulder straps 34 may comprise clasps 38 and shoulder strap length adjusters 40. The shoulder strap length adjusters 40 may be configured to allow for length adjustments of the shoulder straps 34. The clasps 38 may be configured to selectively attach the cups 12 to the shoulder straps 34 at the clasp attachment edges 18. Therefore, in some embodiments, the brassiere 10 may be configured such that each of the cups 12 may be selectively disconnected from its respective one of the shoulder straps 34 to enable the respective breast of the wearer to be exposed. This enables a wearer to directly nurse an infant, or to directly apply the funnel of a pump to the uncovered breast, in a "nursing configuration."

Each cup 12 of the brassiere 10 may comprise a plurality of at least partially overlapping material layers. The cup 12 may comprise a first material layer 42, such as a top (i.e., outermost) material layer (FIG. 3); a second material layer 44, such as a middle material layer (FIG. 4); and a third material layer 46, such as a bottom (i.e., innermost) material layer (FIG. 5). The cups 12, when assembled to form the brassiere 10, may have an appearance substantially similar to the appearance of cups of a conventional brassiere. The brassiere 10 may be configured such that each of the first material layer 42, the second material layer 44, and the third material layer 46 cover and conceal the nipple and the majority of the breast when the layers 42, 44, 46 are in a disengaged configuration and not being stretched. Accordingly, the brassiere 10 may be worn in the same manner as a conventional brassiere, e.g., for long periods of time, as an undergarment, or may be configured as outerwear.

Figure 3:
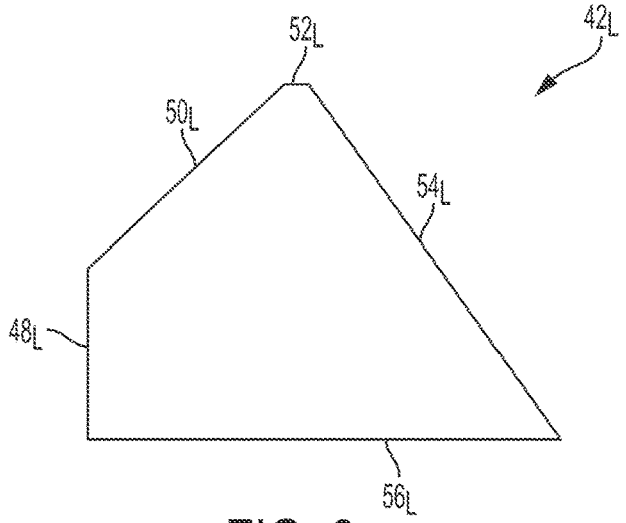
FIG. 3 is a rear elevational view of the first material layer of a left-side brassiere cup of the brassiere of FIGS. 1 and 2, according to the first embodiment, and is a mirror view of the rear elevational view of the first material layer of a right-side brassiere cup of the brassier of FIGS. 1 and 2, according to the first embodiment.
Figure 4:
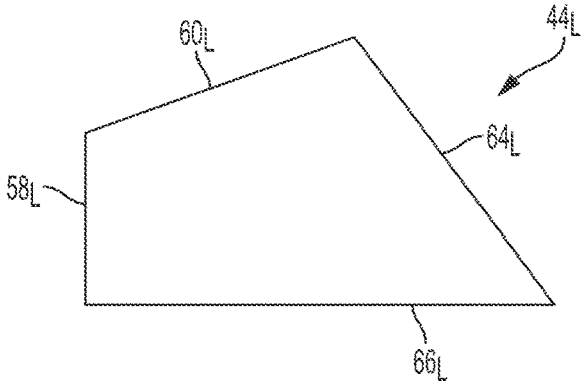
FIG. 4 is a rear elevational view of the second material layer of the left-side brassiere cup of the brassiere of FIGS. 1 through 3, according to the first embodiment, and is a mirror view of the rear elevational view of the second material layer of the right-side brassiere cup of the brassiere of FIGS. 1 through 3, according to the first embodiment.
Figure 5:
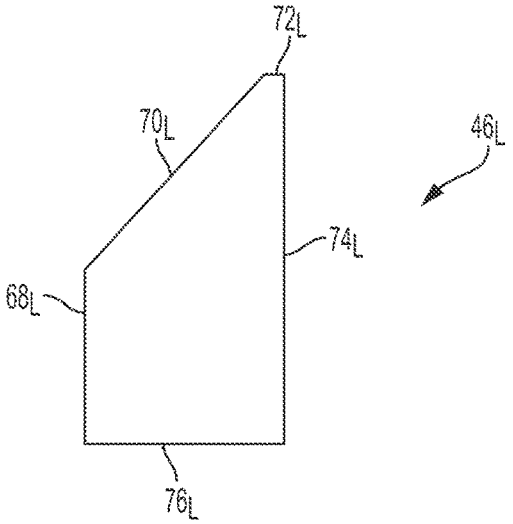
FIG. 5 is a rear elevational view of the third material layer of the left-side brassiere cup of the brassiere of FIGS. 1 through 4, according to the first embodiment, and is a mirror view of the rear elevational view of the third material layer of the right-side brassiere cup of the brassiere of FIGS. 1 through 4, according to the first embodiment.

More particular back views of each material layer of the left-side cup 12 are illustrated in FIGS. 3 through 5. With reference to FIG. 3, the first material layer 42 may comprise a lateral side edge 48, a lateral upper edge 50 extending from the lateral side edge 48 to a clasp attachment edge 52, and a medial side edge 54 extending from the clasp attachment edge 52 to a lower edge 56. The lower edge 56 may extend from the medial side edge 54 to the lateral side edge 48. Each of the edges 48, 50, 52, 54, 56 of the first material layer 42 may be straight or substantially straight. By including straight edges, cutting the material for the first material layer 42 may be simplified, later stitching to join edges may be simplified, and less material may be wasted from cutting out the first material layer 42 from material, as compared to the complexity and waste when curved or more complicated piece patterns, as with many conventional brassieres, are used. The first material layer 42 may be made of a first material that is decorative, so as to add to the aesthetics of the cups 12 when included in the brassiere 10.

The second material layer 44 may comprise a lateral side edge 58, a lateral upper edge 60 extending from the lateral side edge 58 to a medial side edge 64, and the medial side edge 64 extending from the lateral upper edge 60 to a lower edge 66. The lower edge 66 may extend from the medial side edge 64 to the lateral side edge 58. Each of the edges 58, 60, 64, 66 of the second material layer 44 may be straight or substantially straight, which may provide the benefits of simplified material cutting, simplified stitching, and less material waste, as previously discussed. In some embodiments, the second material layer 44 may be made of the same material as the first material used to construct the first material layer 42 so that, when viewed in the brassiere 10, the exteriorly-visible materials visually appear substantially similar. In other embodiments, the second material layer 44 may be made of a second material different from the first material.

The third material layer 46 may comprise a lateral side edge 68, a lateral upper edge 70 extending from the lateral side edge 68 to a clasp attachment edge 72, and a medial side edge 74 extending from the clasp attachment edge 72 to a lower edge 76. The lower edge 76 may extend from the medial side edge 74 to the lateral side edge 68. Each of the edges 68, 70, 72, 74, 76 of the third material layer 46 may be straight or substantially straight, which may provide the benefits of simplified material cutting, simplified stitching, and less material waste, as previously discussed. As the third material layer 46 may not be exteriorly-visible in a front view of the constructed cup 12 (FIG. 1) or the constructed garment (e.g., brassiere 10 (FIG. 1)), the third material layer 46 may be made of either the first material, the second material, or a third material different from either of the first material or the second material.

Figure 6:
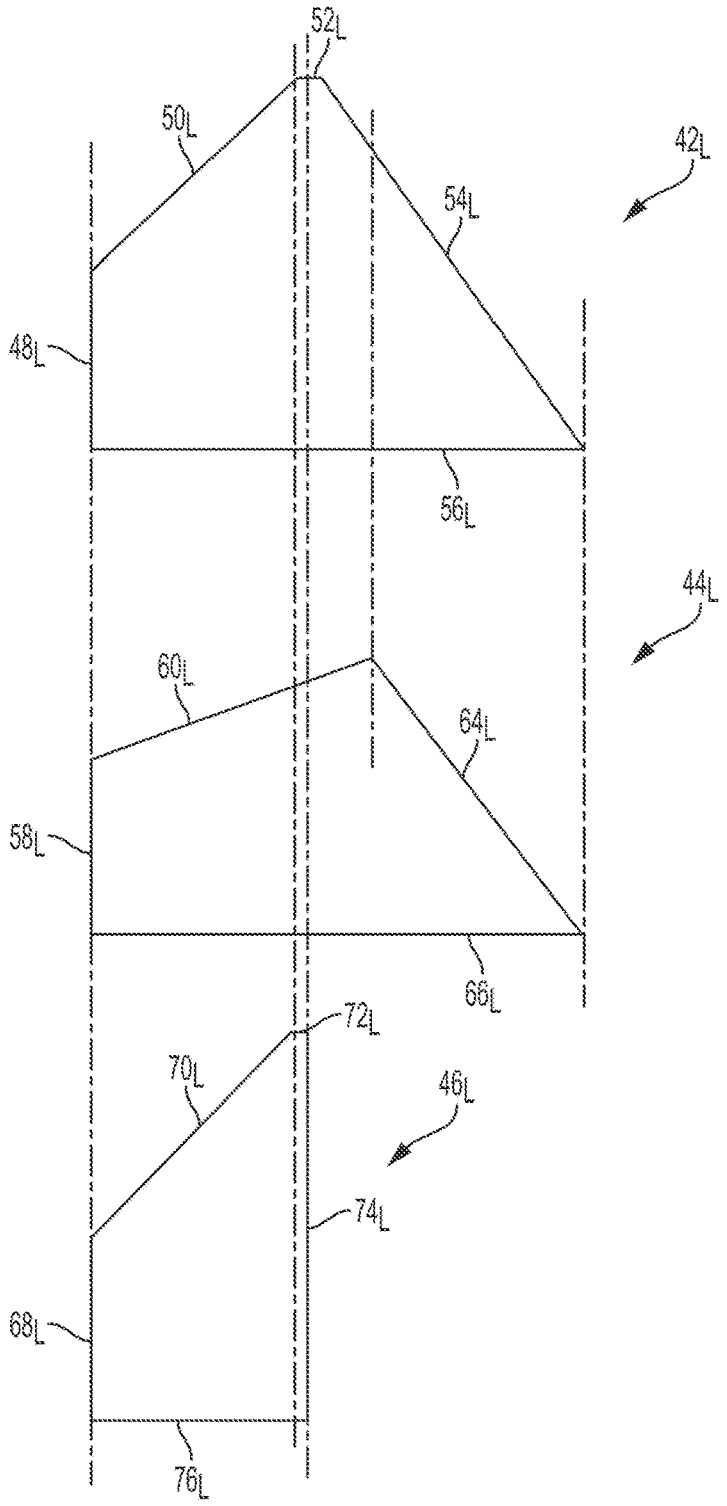
FIG. 6 is an exploded view of the rear sides of the material layers of the left-side brassiere cup of the brassiere of FIGS. 1 through 5, according to the first embodiment, and is a mirror view of an exploded view of the rear sides of the material layers of the right-side brassiere cup of the brassiere of FIGS. 1 through 5, according to the first embodiment.

FIG. 6 shows an exploded view of the first, second, and third material layers 42, 44, 46, respectively, of the cup 12 arranged to at least partially overlap one another. The dashed lines show a lateral alignment of the layers 42, 44, 46.

Figure 7:
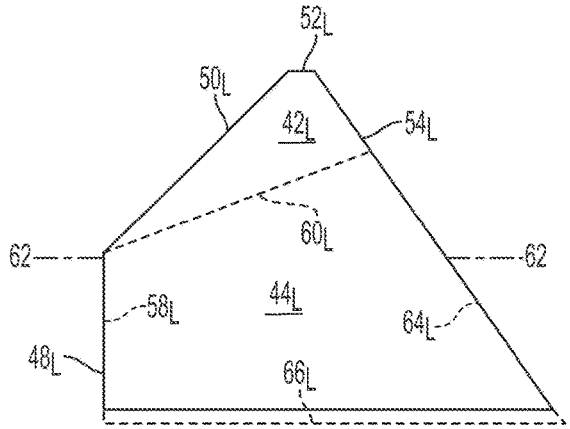
FIG. 7 is a rear elevational view of the second material layer, shown in dashed line, overlapping the first material layer of the left-side brassiere cup of the brassiere of FIGS. 1 through 6, according to the first embodiment, and is a mirror view of the rear elevational view of the second material layer, shown in dashed line, overlapping the first material layer of the right-side brassiere cup of the brassiere of FIGS. 1 through 6, according to the first embodiment.
Figure 8:
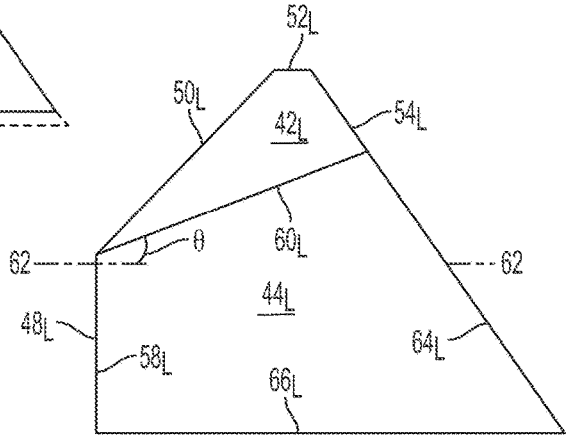
FIG. 8 is a rear elevational view of the second material layer overlapping the first material layer of the left-side brassiere cup of the brassiere of FIGS. 1 through 7, according to the first embodiment, and is a mirror view of the rear elevational view of the second material layer overlapping the first material layer of the right-side brassiere cup of the brassiere of FIGS. 1 through 7, according to the first embodiment.

FIGS. 7 and 8 illustrate the alignment of each of the edges of the first material layer 42 and the second material layer 44. The edges of the second material layer 44 are illustrated as dashed lines in FIG. 7 and as solid lines in FIG. 8. In some embodiments, the lateral side edges 48, 58 may align along a majority of their lengths. The medial side edges 54, 64 may also align along a majority of their lengths. The length of the medial side edge 64 of the second material layer 44 may be less than the length of the medial side edge 54 of the first material layer 42.

In some embodiments, the lateral side edge 58 of the second material layer 44 may be longer than the lateral side edge 48 of the first material layer 42. Therefore, the lower edge 66 of the second material layer 44 may be disposed longitudinally below the lower edge 56 of the first material layer 42. Thus, when the constructed cup 12 (FIG. 1) is viewed from the front, the second material layer 44 may be at least partially exteriorly-visible. In other embodiments, the lower edge 56 of the first material layer 42 may be coextensive with and may align with the lower edge 66 of the second material layer 44, such that the second material layer 44 is not exteriorly-visible from the front of the cup 12 (FIG. 1), when constructed.

The lateral upper edge 60 of the second material layer 44 may be interiorly disposed relative to the lateral upper edge 50 of the first material layer 42. However, the lateral upper edge 60 may be wholly longitudinally above a latitudinal centerline 62 of the cup 12 (FIG. 1). Thus, the second material layer 44 covers a majority of the height of the underlying breast and extends longitudinally above the nipple.

Figure 9:
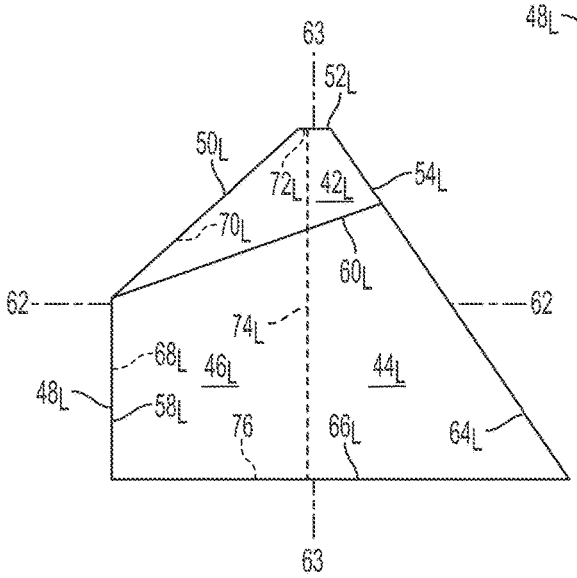
FIG. 9 is a rear elevational view of the third material layer, shown in dashed line, overlapping the second material layer and the first material layer of the left-side brassiere cup of the brassiere of FIGS. 1 through 8, according to the first embodiment, and is a mirror view of the rear elevational view of the third material layer, shown in dashed line, overlapping the second material layer and the first material layer of the right-side brassiere cup of the brassiere of FIGS. 1 through 8, according to the first embodiment.
Figure 10:
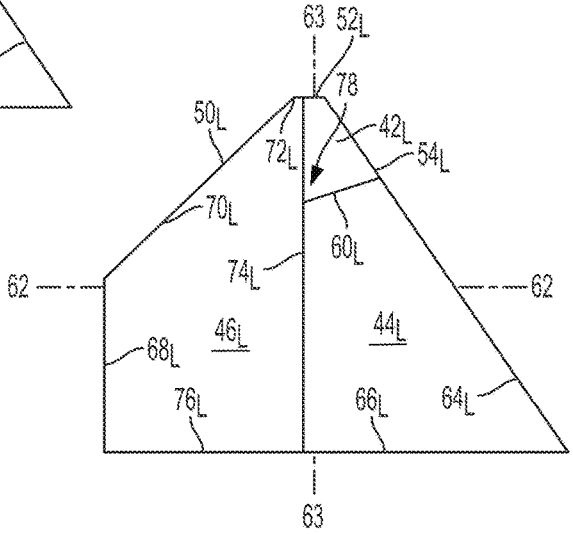
FIG. 10 is a rear elevational view of the third material layer overlapping the second material layer and the first material layer of the left-side brassiere cup of the brassiere of FIGS. 1 through 9, according to the first embodiment, and is a mirror view of the rear elevational view of the third material layer overlapping the second material layer and the first material layer of the right-side brassiere cup of the brassiere of FIGS. 1 through 9, according to the first embodiment.

FIGS. 9 and 10 illustrate the alignment of each edge of the first material layer 42, the second material layer 44, and the third material layer 46. The edges of the third material layer 46 are illustrated as dashed lines in FIG. 9 and as solid lines in FIG. 10. Each of the lateral side edges 48, 58, 68 may align with one another along a majority of their lengths. The lateral upper edge 50 of the first material layer 42 and the lateral upper edge 70 of the third material layer 46 may align with one another along their lengths. The lower edge 66 of the second material layer 44 and the lower edge 76 of the third material layer 46 may align along the length of the lower edge 76 of the third material layer 46, which may be shorter than the length of the lower edge 66 of the second material layer 44. The clasp attachment edge 52 of the first material layer 42 and the clasp attachment edge 72 of the third material layer 46 may align along the length of the clasp attachment edge 72 of the third material layer 46, which may be shorter than the length of the clasp attachment edge 52 of the first material layer 42. In other embodiments, the length of the clasp attachment edge 72 of the third material layer 46 may be equal to (e.g., coextensive with) the length of the clasp attachment edge 52 of the first material layer 42. The third material layer 46 may extend laterally, from the lateral side edge 68 (at the lateral side edge 14 of the cup 12 (FIG. 1)), to or toward a longitudinal centerline 63 of the cup 12 (FIG. 1). In some embodiments, the medial side edge 74 may align with the longitudinal centerline 63 or may be less than two centimeters (2 cm) (e.g., less than about one centimeter (1 cm)) to a lateral or medial side of the longitudinal centerline 63.

The third material layer 46 may at least partially overlap (from a rear view perspective) the second material layer 44 and may be arranged such that the lateral upper edge 60 of the second material layer 44 and the medial side edge 74 of the third material layer 46 cross one another, defining a nook 78. The nook 78 may be defined at at least one of the peripheral edges of the cup 12 (FIG. 1), e.g., at the lateral side edge 14, the lateral upper edge 16, the clasp attachment edge 18, the medial side edge 20, and the lower edge 22 of the cup 12 (FIG. 1). As discussed in more detail below, a funnel of a breast pump is receivable within the nook 78. For example, as illustrated in FIG. 10, the nook 78 may be defined with its mouth directed upwardly and medially, as along an upper portion of the medial side edge 20 (FIG. 1) and, optionally, also along a medial portion of the clasp attachment edge 18.

The nook 78 may be substantially V-shaped as defined by a portion of the lateral upper edge 60 of the second material layer 44 and a portion of the medial side edge 74 of the third material layer 46. As used herein, the term "V-shaped" means and includes a shape defined by two sides meeting at a point and defining an angle of less than 180°. It includes a right-angled V-shape, which is also referred to herein as an "L-shape," in which the two sides meet at a point and define an angle of 90° or about 90°. It also includes an acute-angled V-shape, in which the two sides meet at an angle of less than 90°.

The first material layer 42 may at least partially overlap the nook 78 (e.g., may fully overlap the nook 78), such that the nook 78 is not exteriorly-visible from a front view of the cup 12 (FIG. 1) in the disengaged configuration illustrated in FIG. 1. The covering of the nook 78 by the first material layer 42, in the disengaged configuration illustrated in FIG. 10, may define a substantially triangular shape formed by, for example, the lateral upper edge 60 of the second material layer 44, the medial side edge 74 of the third material layer 46, and the medial side edge 54 of the first material layer 42.

Figure 11:
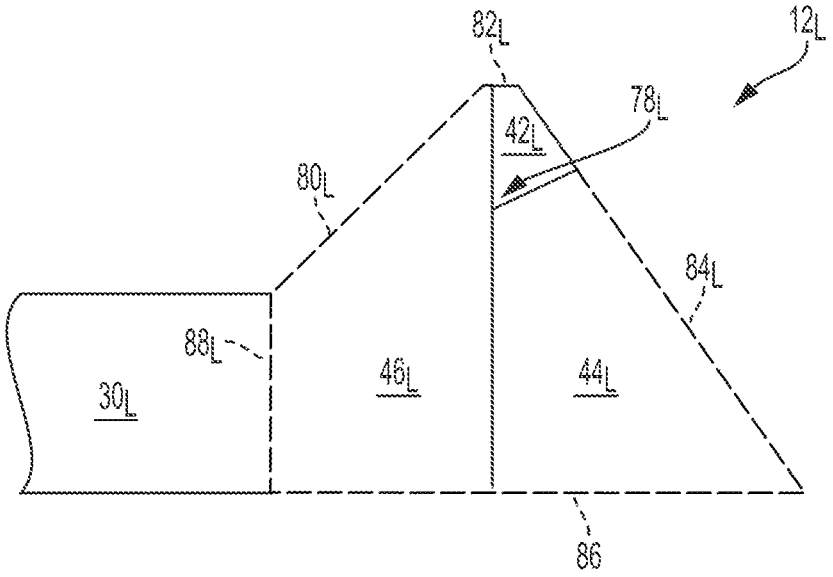
FIG. 11 is a partial, rear elevational view of the left-side brassiere cup incorporated within the brassiere of FIGS. 1 through 10, according to the first embodiment, and is a mirror view of the partial, rear elevational view of the right-side brassiere cup incorporated within the brassiere of FIGS. 1 through 10, according to the first embodiment.

FIG. 11 illustrates a partial, back view of a constructed cup 12. In construction, a first seam 80 may join the first material layer 42 and the third material layer 46 along the lateral upper edges 50, 70 (FIGS. 7 through 10) thereof, which may collectively form attached edges of the lateral upper edge 16 (FIG. 1) of the cup 12. A second seam 82 may join the first material layer 42 and the third material layer 46 along the clasp attachment edges 52, 72 (FIGS. 7 through 10) thereof, which may collectively form attached edges of the clasp attachment edge 18 (FIG. 1) of the cup 12. A third seam 84 may join the first material layer 42 and the second material layer 44 along the medial side edges 54, 64 (FIGS. 7 through 10) thereof, which may collectively form attached edges of the medial side edge 20 (FIG. 1) of the cup 12. As illustrated in FIG. 1, each of the first seam 80, the second seam 82, and the third seam 84 illustrated in FIG. 11 may be covered by, or otherwise lined with, edging 28 (FIG. 1), such that the seams 80, 82, 84 (FIG. 11) may not be visible in a final construction of the brassiere 10 (FIG. 1).

A fourth seam 86 may join the second material layer 44 and the third material layer 46 along the lower edges 66, 76 (FIGS. 7 through 10) thereof, which may collectively form the lower edge 22 (FIG. 1) of the cup 12. A fifth seam 88 may join the first material layer 42, the second material layer 44, and the third material layer 46 along the lateral side edges 48, 58, 68 (FIGS. 7 through 10) thereof, which may collectively form attached edges of the lateral side edge 14 (FIG. 1) of the cup 12. The fifth seam 88 may further join the cup 12 to the adjustable back band 30 along the lateral side edge 14 (FIG. 1). The first material layer 42, the second material layer 44, and the third material layer 46 may be joined, as described, by seaming or other conventional techniques, which are not described in detail herein.

Figure 12:
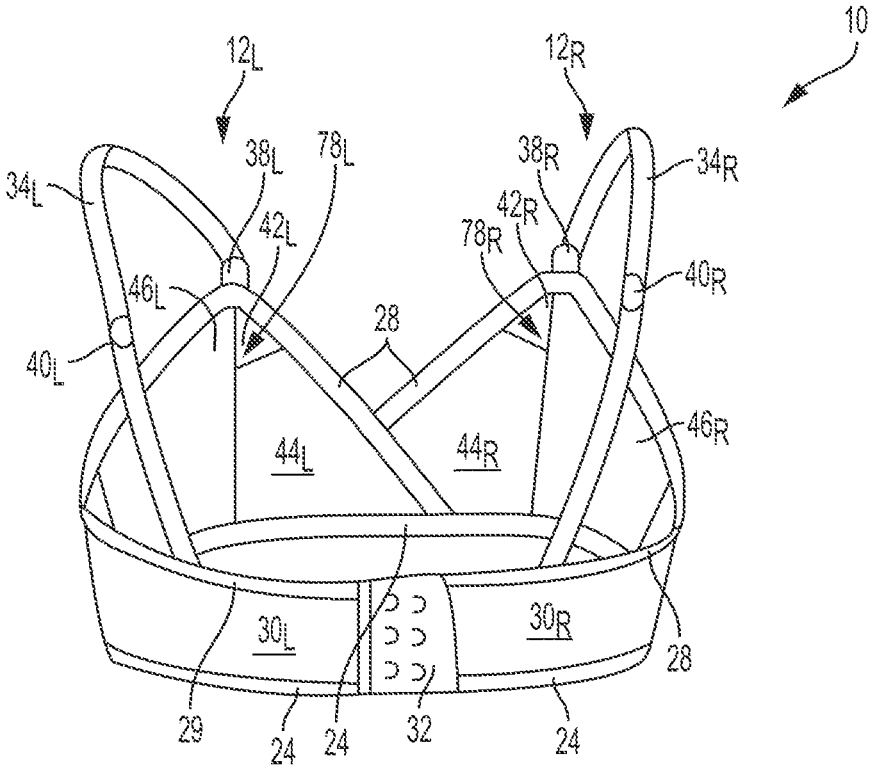
FIG. 12 is a perspective, back view of the brassiere of FIGS. 1 through 11 with the front brassiere portion comprising the brassiere cups, according to the first embodiment.
Figure 13:
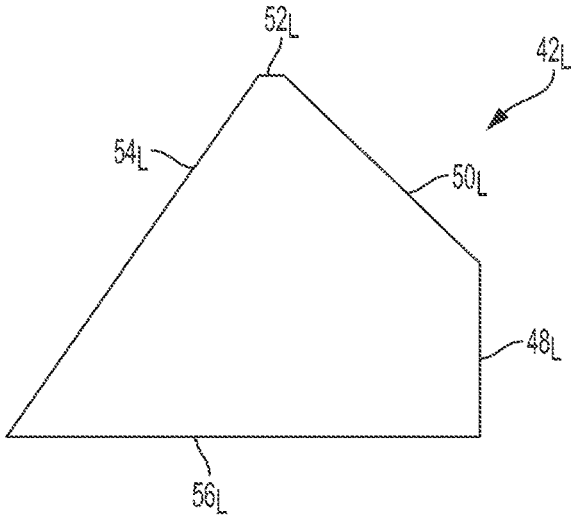
FIG. 13 is a front elevational view of the first material layer of the left-side brassiere cup of the brassiere of FIGS. 1 through 12, according to the first embodiment, and is a mirror view of the front elevational view of the first material layer of the right-side brassiere cup of the brassiere of FIGS. 1 through 12, according to the first embodiment.
Figure 14:
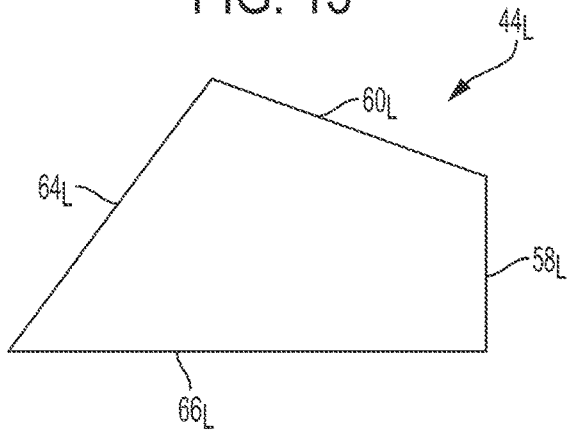
FIG. 14 is a front elevational view of the second material layer of the left-side brassiere cup of the brassiere of FIGS. 1 through 13, according to the first embodiment, and is a mirror view of the front elevational view of the second material layer of the right-side brassiere cup of the brassiere of FIGS. 1 through 13, according to the first embodiment.
Figure 15:
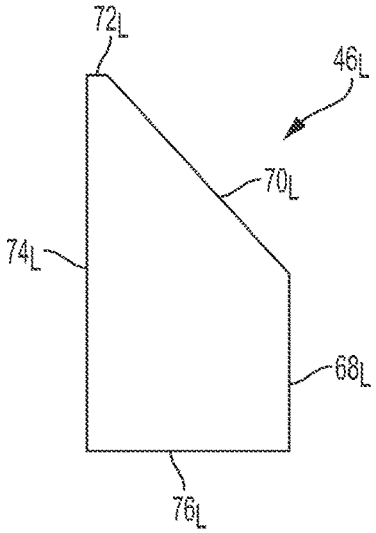
FIG. 15 is a front elevational view of the third material layer of the left-side brassiere cup of the brassiere of FIGS. 1 through 14, according to the first embodiment, and is a mirror view of the front elevational view of the third material layer of the right-side brassiere cup of the brassiere of FIGS. 1 through 14, according to the first embodiment.
Figure 16:
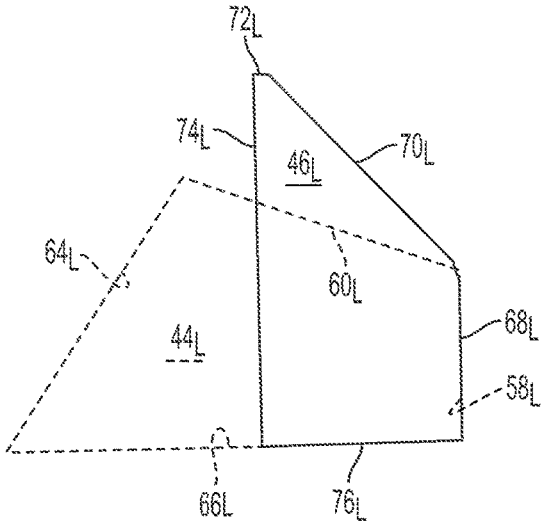
FIG. 16 is a front elevational view of the second material layer, shown in dashed line, overlapping the third material layer of the left-side brassiere cup of the brassiere of FIGS. 1 through 15, according to the first embodiment, and is a mirror view of the front elevational view of the second material layer, shown in dashed line, overlapping the third material layer of the right-side brassiere cup of the brassiere of FIGS. 1 through 15, according to the first embodiment.
Figure 17:
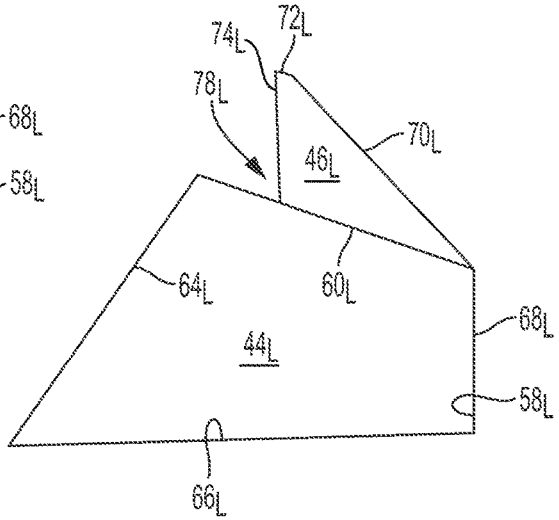
FIG. 17 is a front elevational view of the second material layer overlapping the third material layer of the left-side brassiere cup of the brassiere of FIGS. 1 through 16, according to the first embodiment, and is a mirror view of the front elevational view of the second material layer overlapping the third material layer of the right-side brassiere cup of the brassiere of FIGS. 1 through 16, according to the first embodiment.
Figure 18:
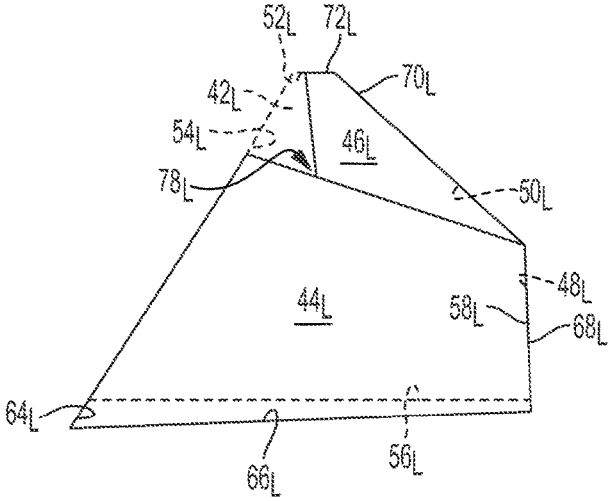
FIG. 18 is a front elevational view of the first material layer, shown in dashed line, overlapping the second material layer and the third material layer of the left-side brassiere cup of the brassiere of FIGS. 1 through 17, according to the first embodiment, and is a mirror view of the front elevational view of the first material layer, shown in dashed line, overlapping the second material layer and the third material layer of the right-side brassiere cup of the brassiere of FIGS. 1 through 17, according to the first embodiment.
Figure 19:
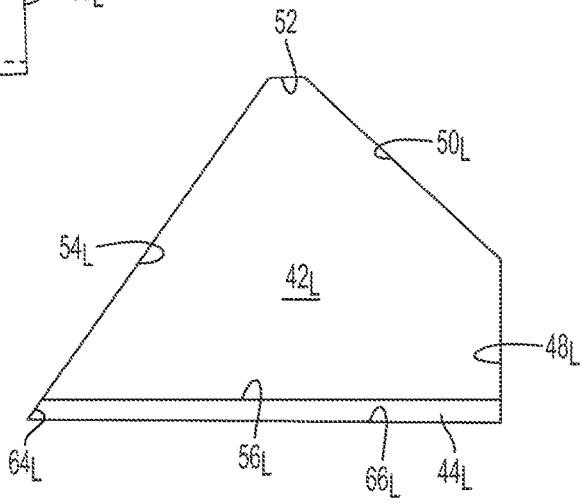
FIG. 19 is a front elevational view of the first material layer overlapping the second material layer and the third material layer of the left-side brassiere cup of the brassiere of FIGS. 1 through 18, according to the first embodiment, and is a mirror view of the front elevational view of the first material layer overlapping the second material layer and the third material layer of the right-side brassiere cup of the brassiere of FIGS. 1 through 18, according to the first embodiment.
Figure 20:
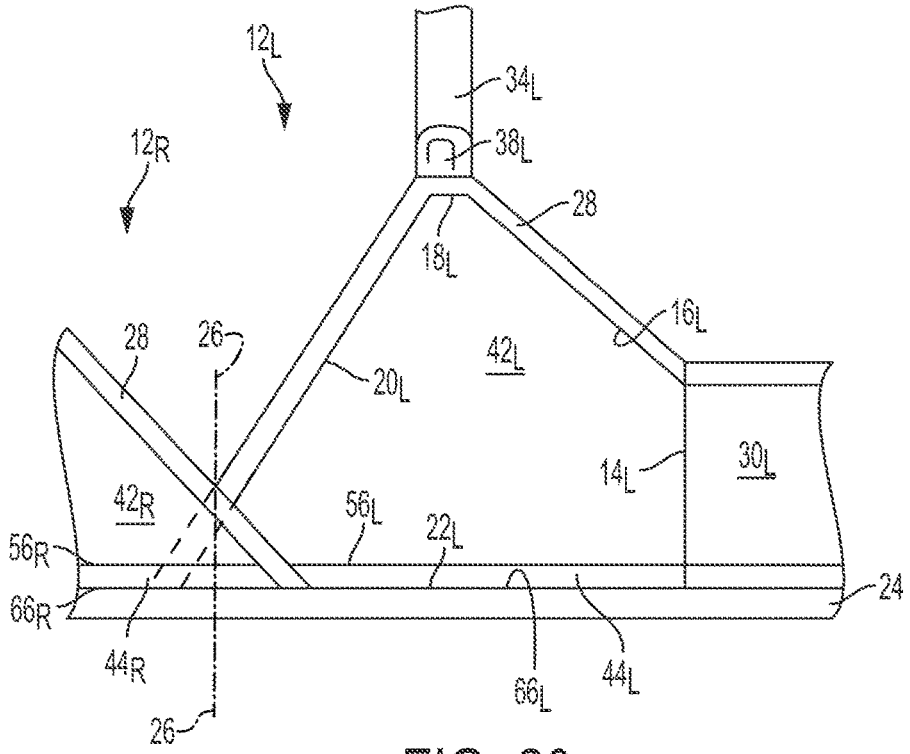
FIG. 20 is a partial, front elevational view of the left-side brassiere cup incorporated within the brassiere of FIGS. 1 through 19, according to the first embodiment, and is a mirror view of a partial, front elevational view of the right-side brassiere cup incorporated within the brassiere of FIGS. 1 through 19, according to the first embodiment.

FIG. 12 illustrates a rear view of the cups 12 comprising the three material layers 42, 44, 46 incorporated in the brassiere 10. When fully constructed, the lower edges 66, 76 (FIGS. 7 through 10) of the second and third material layers 44, 46 may be attached to the rib band 24. The clasp attachment edges 52, 72 (FIGS. 7 through 10) of the first and third material layers 42, 46 may be attached, fixedly, to a respective one of the shoulder straps 34. Alternatively, the clasp attachment edges 52, 57 (FIGS. 7 through 10) of the first and third material layers 42, 46 may be releasably attached to a respective one of the shoulder straps 34 by the clasps 38, as illustrated in FIG. 12.

In other embodiments, the shoulder straps 34 may be configured other than as front-to-back, shoulder straps connected by the clasps 38. For example, the shoulder straps 34 may, alternatively, be joined by seams to the first and third material layers 42, 46. In some embodiments, the shoulder straps 34 may be a seamless, continuous extension of a piece of fabric forming one of the first or the third material layer 42, 46. In these or other embodiments, the shoulder straps 34 may alternatively be adjustable to form other configurations of straps, such as criss-cross straps, one-shoulder strap, etc. In still other embodiments, the shoulder straps 34 may be formed as a halter top support, as a razor back support, or the like. Thus, other conventional strap or support configurations may be implemented without departing from the present disclosure.

In some embodiments, the fabric forming the back band 30 joined to the cup 12 by the fifth seam 88 may be a continuous panel of fabric also forming one of the material layers 42, 44, 46 of the cup 12. The fifth seam 88 may transect the continuous panel to define the back band 30 to one side of the fifth seam 88 and the one of the material layers 42, 44, 46 to the other side of the fifth seam 88. Nonetheless, in such embodiments, the back band 30 is not formed by an initially separate piece of fabric that is then joined to each of three initially separate pieces of fabric for the material layers 42, 44, 46. The inclusion of the back band 30 as a continuous panel of fabric also forming one of the material layers 42, 44, 46 may improve simplicity of fabric cutting, simplicity of stitching (fabrication), and provide less fabric waste, as compared to using an initially-separate piece of fabric for the back band 30.

With further reference to FIGS. 7 through 10, in construction, the lower edge 56 of the first material layer 42, the lateral upper edge 60 of the second material layer 44, and the medial side edge 74 of the third material layer 46 may remain at least partially unattached or unconnected to another material layer of the cup 12, defining free edges of the cup 12. In some embodiments, the free edges may lack any means to secure the free edge along its length, interior to the periphery of the cup 12, to another material layer of the brassiere 10. In other embodiments, free edges may comprise means to selectively secure a portion of the length thereof to another material layer of the brassiere 10 by securing means, such as by snaps, buttons, hook-and-loop engagements, or the like. The free edges may be selectively unattached from the securing means when the cup 12 is used in a pumping configuration.

With further reference to FIG. 1 and FIGS. 7 through 10, the medial side edge 74 of the third material layer 46—which edge may be a free edge—may extend vertically between the clasp attachment edge 18 and the lower edge 22 of the cup 12 (FIG. 11). The medial side edge 74 may be a substantially straight edge extending substantially parallel to the medial centerline 26 (FIG. 1) of the brassiere 10 and proximate to, or at, the longitudinal centerline 63 (FIG. 10) of the cup 12 (FIG. 11). Thus, the free edge (e.g., the medial side edge 74) of the third material layer 46 may extend from an upper peripheral edge (e.g., the clasp attachment edge 18) of the cup 12 to a lower peripheral edge (e.g., the lower edge 22) of the cup 12.

The lateral upper edge 60 of the second material layer 44—which edge may be a free edge—may extend horizontally, or substantially horizontally (i.e., at an angle θ (FIG. 8) of less than 30°, e.g., less than 20°, e.g., less than 10°, relative to a horizontal line parallel to the latitudinal centerline 62 of the cup 12 and intersecting the point where the lateral side edge 58 and the lateral upper edge 60 of the second material layer 44 meet) between the lateral side edge 68—at the lateral side edge 14 of the cup 12—and the medial side edge 64—at the medial side edge 20 of the cup 12. Thus, the free edge (e.g., the lateral upper edge 60) of the second material layer 44 may extend from a lateral peripheral edge (e.g., the lateral side edge 14) of the cup 12 to a medial peripheral edge (e.g., the medial side edge 20) of the cup 12.

The lower edge 56 of the first material layer 42—which edge may be a free edge—may extend horizontally, or substantially horizontally, between the lateral side edge 48—at the lateral side edge 14 of the cup 12—and the medial side edge 54—at the medial side edge 20 of the cup 12. The lower edge 56 of the first material layer 42 may be a substantially straight edge extending parallel to, or substantially parallel to, the lower edge 22 of the cup 12. Thus, the free edge (e.g., the lower edge 56) of the first material layer 42 may extend from a lateral peripheral edge (e.g., the lateral side edge 14) of the cup 12 to a medial peripheral edge (e.g., the medial side edge 20) of the cup 12.

Figure 21:
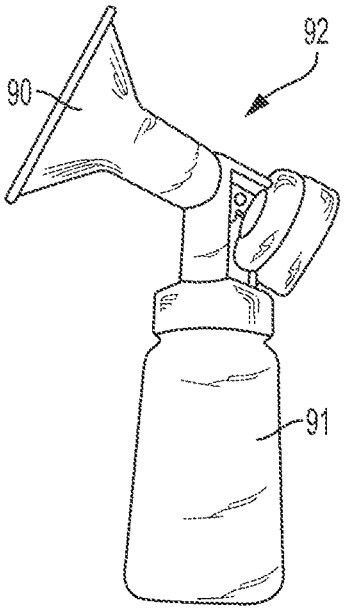
FIG. 21 (RELATED ART)
FIG. 21 is a side elevational view of a funnel and a reservoir of a conventional breast pump.
Figure 22:
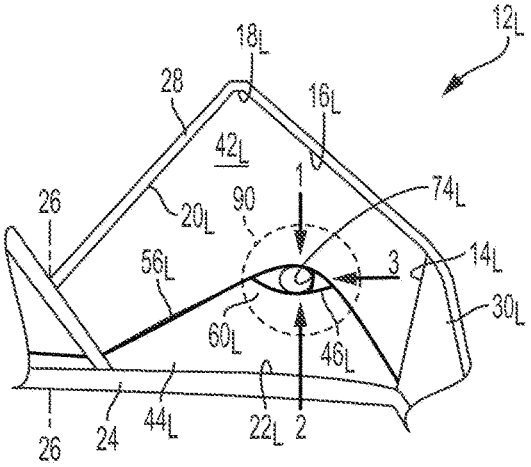
FIG. 22 is a partial, front elevational view of the brassiere of FIGS. 1 through 20, incorporating the left-side brassiere cup according to the first embodiment, and a mirror view of a partial, front elevational view of the brassiere of FIGS. 1 through 20, incorporating the right-side brassiere cup according to the first embodiment, with the funnel of the breast pump received in the cup and located in a first position.
Figure 23:
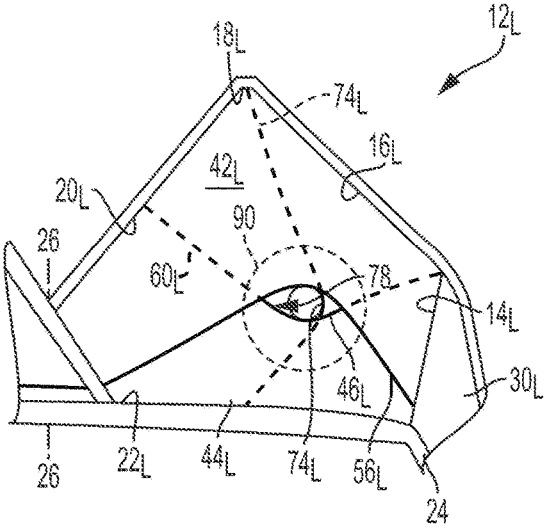
FIG. 23 is a partial, front elevational view of the brassiere of FIGS. 1 through 20 and FIG. 22, incorporating the left-side brassiere cup according to the first embodiment, and a mirror view of a partial, front elevational view of the brassiere of FIGS. 1 through 20 and FIG. 22, incorporating the right-side brassiere cup according to the first embodiment, with the funnel of the breast pump received in the cup and located in the first position, with some hidden edges of the second material layer and the third material layer in dashed line.
Figure 24:
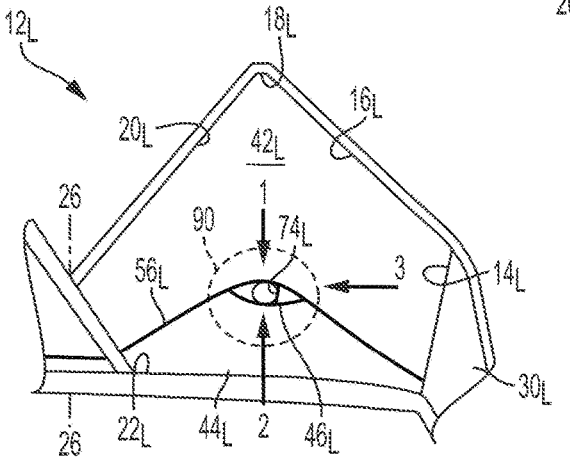
FIG. 24 is a partial, front elevational view of the brassiere of FIGS. 1 through 20 and FIGS. 22 and 23, incorporating the left-side brassiere cup according to the first embodiment, and a mirror view of a partial, front elevational view of the brassiere of FIGS. 1 through 20 and FIGS. 22 and 23, incorporating the right-side brassiere cup according to the first embodiment, with the funnel of the breast pump received in the cup and located in the second position.
Figure 25:
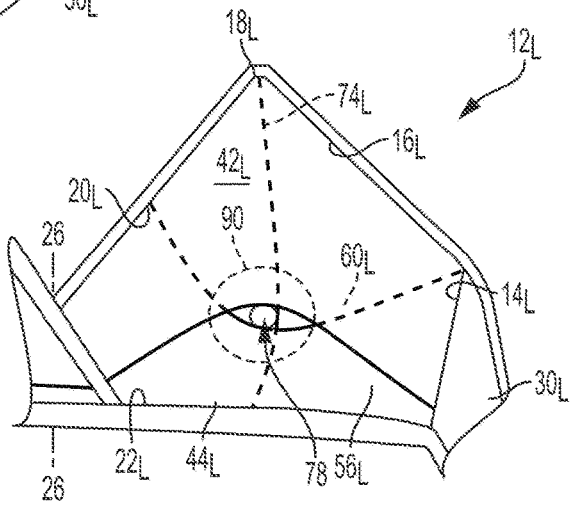
FIG. 25 is a partial, front elevational view of the brassiere of FIGS. 1 through 20 and FIGS. 22 through 24, incorporating the left-side brassiere cup according to the first embodiment, and a mirror view of a partial, front elevational view of the brassiere of FIGS. 1 through 20 and FIGS. 22 through 24, incorporating the right-side brassiere cup, according to the first embodiment, with the funnel of the breast pump received in the cup and located in the second position, with some hidden edges of the second material layer and the third material layer in dashed line.

While the rear views of the overlapping material layers of the brassiere 10 are illustrated in FIGS. 3 through 12, FIGS. 13 through 20 depict the front views of the material layers 42, 44, 46, the cup 12, and the cup 12 as incorporated into the brassiere 10 (FIG. 1). In some embodiments, each of the lower edge 56 of the first material layer 42, the lateral upper edge 60 of the second material layer 44, and the medial side edge 74 of the third material layer 46 may at least partially define the nook 78 (FIG. 17) into which a funnel 90 (FIG. 21) of a breast pump 92 (FIG. 21) may be received. Configurations of the funnel 90 and of the breast pump 92 are conventional and are not discussed in detail herein.

FIGS. 22 through 25 illustrate a front-view of the left-side cup 12 of the brassiere 10 configured to receive the funnel 90 in a pumping configuration. The free edges (i.e., edges 56, 60, 74) are shown as dashed lines in FIGS. 23 and 25 where the free edges of the second material layer 44 and the third material layer 46 (i.e., edges 60, 74) are hidden from view by the first material layer 42 or the second material layer 44. Each of the free edges (i.e., edges 56, 60, and 74) of the material layers 42, 44, 46, respectively, of the cup 12 is configured to support the funnel 90 of the conventional breast pump 92 (FIG. 21) from a respectively different direction and against a nipple of a breast and to prevent the funnel 90 from moving out of place, even as a reservoir 91 of the pump 92 fills with expressed milk.

In some embodiments, the first material layer 42, the second material layer 44, and the third material layer 46 may comprise a uniformly stretchable material such as spandex, LYCRA®, nylon, or the like, or blends thereof. As described with reference to FIGS. 3 through 5, each of the first material layer 42, second material layer 44, and third material layer 46 may be made from the same material or from different materials. In other embodiments, only the free edges of the first material layer 42, second material layer 44, and third material layer 46 (i.e., edges 56, 60, and 74) comprise a stretchable material, such as a band of elastic. The stretchable material causes an elastic-like pull, from multiple directions, against the funnel 90 of the breast pump 92 (FIG. 21) when the funnel 90 is received in the nook 78 and behind the free edge of the first material layer 42 (i.e., edge 56). In any regard, the free edge of each material layer may be configured to be stretched away from its respective non-stretched shape to accommodate insertion of the funnel 90 within the nook 78.

With continued references to FIGS. 22 through 25, the funnel 90 may be supported in at least three directions. The lower edge 56 of the first material layer 42 may be stretched away from the lower edge 22 of the cup 12. The lower edge 56 of the first material layer 42 may support the funnel 90 substantially from above and provide a downward force on the funnel 90 as indicated by directional arrow 1. The lateral upper edge 60 of the second material layer 44 may be stretched away from the lateral upper edge 16 and the clasp attachment edge 18 of the cup 12. The lateral upper edge 60 of the second material layer 44 may support the funnel 90 substantially from below and provide an upward force on the funnel 90 as indicated by directional arrow 2. The medial side edge 74 of the third material layer 46 may be stretched away from the medial side edge 20 of the cup 12 and the medial centerline 26 of the brassiere 10 (FIG. 1). The medial side edge 74 of the third material layer 46 may support the funnel 90 substantially from the lateral side and provide a lateral force on the funnel 90 toward the medial centerline 26, as indicated by directional arrow 3. Thus, the three-directional forces, provided by the free edges (i.e., edges 56, 60, 74) hold the funnel 90 in tension when the funnel 90 is positioned over the nipple, even as milk is expressed from the breast and the reservoir 91 (FIG. 21) of the breast pump 92 (FIG. 21) is filled and becomes heavier. Further, as each of the material layers is somewhat stretched away from the chest to accommodate the breast and the funnel 90, each material layer urges the funnel 90 to remain pressed against the nipple and breast. Accordingly, the funnel 90 may be supported in a direction perpendicular to the surface of the cup 12. Still further, because the free edge of the third material layer 46 (i.e., the medial side edge 74) spans from an upper peripheral edge of the cup 12 to a lower peripheral edge of the cup 12, the funnel 90 may be selectively positioned, in the nook 78, at essentially any point along the height of the cup 12. Moreover, the periphery-to-periphery spanning free edge (i.e., the medial side edge 74) provides lateral support to the funnel 90 even as the funnel 90 may move longitudinally lower as the reservoir 91 (FIG. 21) of the breast pump 92 (FIG. 21) fills during pumping. In addition, the lateral support in the direction of arrow 3, toward the medial centerline 26 (and toward the sternum of the wearer) urges the funnel 90 and the breast pump 92 (FIG. 21) to remain central to the wearer's body and away from the wearer's arms. This enables the arms to remain free to engage in other activities (e.g., typing, phone handling, and the like) during hands-free pumping. The medially directed lateral support force, in the direction of arrow 3, also lessens the likelihood of the breast pump 92 (FIG. 21) being accidentally contacted by the wearer's arm or by other objects, while the wearer is using the brassiere 10 for hands-free pumping.

It should be noted that while FIGS. 22 through 25 show the left-side cup $\mathbf{12}_L$, the views of the right-side cup $\mathbf{12}_R$ would simply be mirror images of these figures (and those components designated with the subscript "L" would be referenced with the subscript "R"). Further, though FIGS. 22 through 25 illustrate insertion of the funnel 90 in only the left-side cup $\mathbf{12}_L$, a pair of funnels 90 may be received in the pair of nooks 78 (the left-side nook $\mathbf{78}_L$ and the right-side nook $\mathbf{78}_R$) of the brassiere 10, i.e., in each of the right-side cup $\mathbf{12}_R$ and the left-side cup $\mathbf{12}_L$ concurrently.

Figure 26:
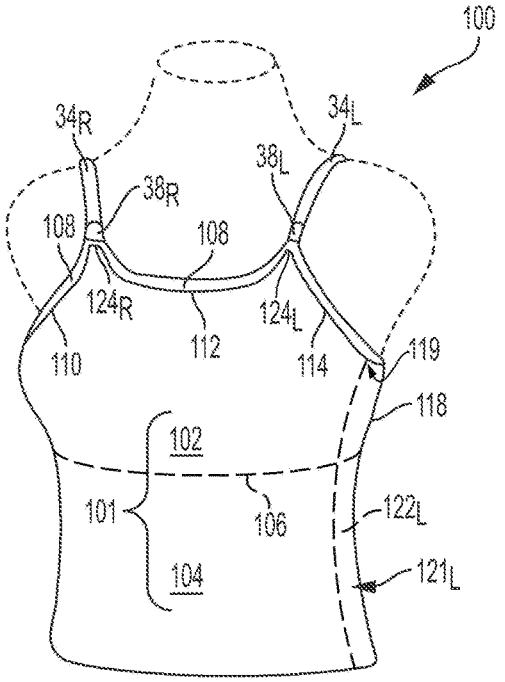
FIG. 26 is a perspective, front elevational view of a garment, according to a second embodiment of the present disclosure, in the configuration of a tank top incorporating a front overlay overlaying the front brassiere portion of the brassiere of FIGS. 1 through 20 and FIGS. 22 through 24, according to the first embodiment.
Figure 27:
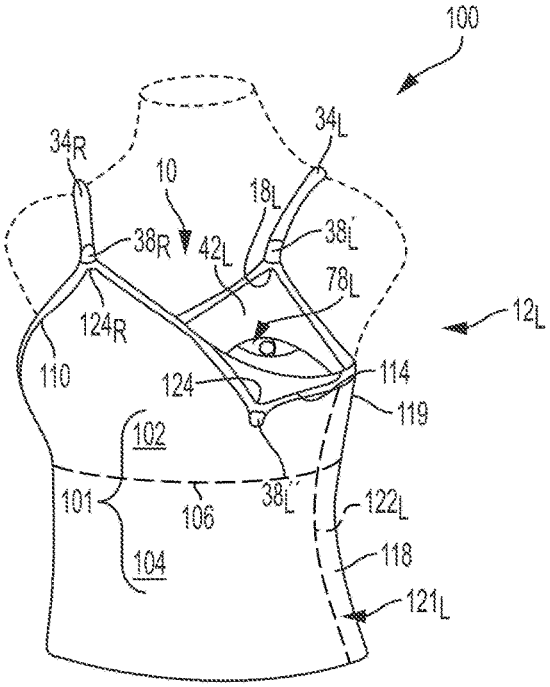
FIG. 27 is a perspective, front elevational view of the tank top of FIG. 26, according to the second embodiment, with one selectively releasable clasp unclasped.
Figure 28:
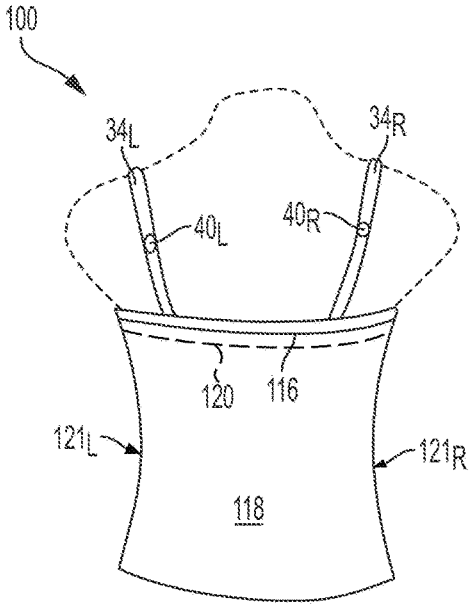
FIG. 28 is a back view of the tank top of FIGS. 26 and 27, according to the second embodiment.

In at least a second embodiment of the present disclosure, the brassiere 10 (FIG. 1) may be incorporated into a garment 100 configured as outerwear, such as a tank top illustrated in FIGS. 26 through 28. FIGS. 26 and 27 illustrate front views of the garment 100 for a nursing woman according to at least one embodiment. FIG. 28 illustrates a rear view of the garment 100 of FIGS. 26 and 27. In some embodiments, the front exterior of the garment 100 may comprise a front overlay 101. The front overlay 101 may comprise an upper overlay portion 102 and a lower overlay portion 104. The upper overlay portion 102 and the lower overlay portion 104 may be portions of a unitary panel of material. Alternatively, each of the upper overlay portion 102 and the lower overlay portion 104 may be a piece (or pieces) of material connected by a seam 106 extending under a bust line from a right lateral side $\mathbf{121}_R$ of the garment 100 to a left lateral side 124 of the garment 100. The lateral sides 121 may align with, and extend longitudinally below, a corresponding one of the lateral side edges 14 (FIG. 1) of the cup 12 of the underlying brassiere 10. Edging 108 may be provided along a right lateral upper edge 110, a central upper edge 112, and a left lateral upper edge 114 to add to the aesthetics of the garment 100 and the comfort of the wearer.

Each of the right lateral upper edge 110, the central upper edge 112, and the left lateral upper edge 114 may not be affixed, along their lengths, to the underlying brassiere 10 (FIG. 1). The front overlay 101 may be affixed directly to each of the cups 12 of the brassiere 10 only at, for example, an upper point (point 119 (FIG. 27)) of the lateral side edges 14 of the cups 12. The garment 100 may be affixed, or releasably connected (e.g., by a zipper or the like), to the upper peripheral edge 29 (FIG. 2) of the adjustable back band 30 of the brassiere 10 along an upper peripheral edge 116 of a back overlay 118 (FIG. 28). The upper peripheral edge 116 of the back overlay 118 may be joined to the brassiere 10 by a seam 120, an adhesive, a zipper, lacing, a plurality of snaps, or the like. The back overlay 118 may be joined to each of the upper and lower overlay portions 102, 104 of the front overlay 101 by lateral side seams 122.

The upper overlay portion 102 may be configured to accommodate hands-free breast pumping. As shown in FIGS. 26 and 27, the garment 100 may include the pair of clasps 38. Each of the clasps 38 includes at least two selectively joinable portions (e.g., a first joinable portion 38' and a second joinable portion 38"). The first joinable portion 38' may be affixed to the shoulder strap 34, and joined, either affixedly or releasably, to the cup 12 of the brassiere 10. The second joinable portion 38" may be affixed to the upper overlay portion 102 of the front overlay 101 at, for example, an attachment edge 124. Each clasp 38 may be configured to be selectively disengaged by disconnecting the first joinable portion 38' from the second joinable portion 38", to allow the upper overlay portion 102 to be moved away from at least one of the shoulder straps 34, uncovering the brassiere 10 thereunder and allowing for hands-free breast pumping when using the brassiere 10 in the pumping configuration (FIG. 27). That is, after releasing the upper overlay portion 102 to uncover the underlying cup 12 of the brassiere 10, the free edges (i.e., edges 56, 60, 74 (FIGS. 22 through 25)) of the cup 12 may then be pulled away and the funnel 90 (FIG. 21) inserted into the nook 78, as described with reference to FIGS. 22 through 25 and as illustrated in FIG. 27.

In some embodiments, the clasps 38 may have a third joinable portion (not shown) that, when engaged with the first joinable portion 38', joins the cup 12 of the brassiere 10 to the shoulder strap 34 and, when disengaged from the first joinable portion 38', enables uncovered access to the underlying breast (the nursing configuration) so that a child may be directly nursed or so that a funnel 90 (FIG. 21) may be directly applied to the breast, if the wearer is occasionally inclined to use the breast pump 92 (FIG. 21) without the hands-free support.

Figure 29:
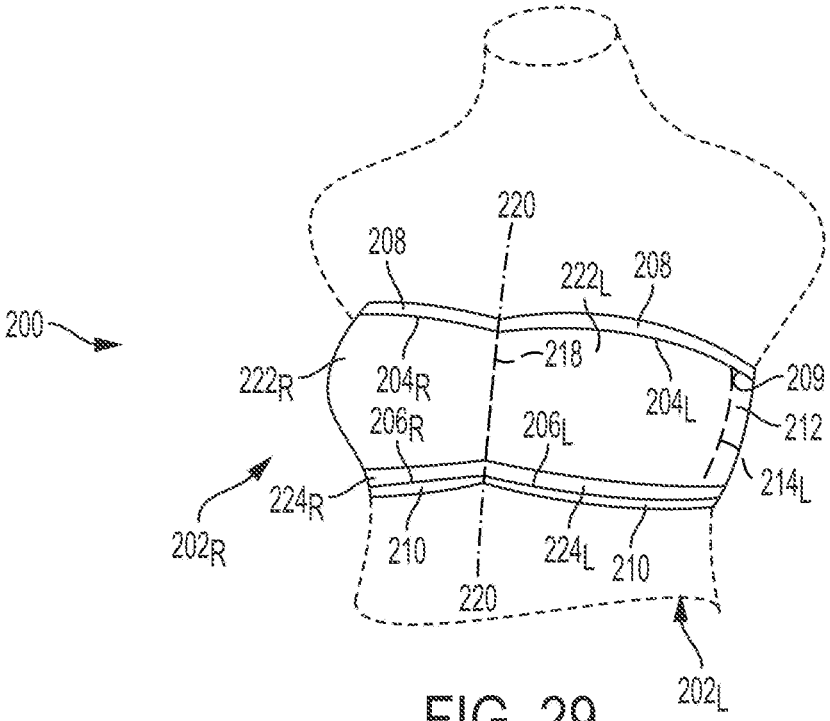
FIG. 29 is a perspective, front and left-side elevational view of a garment, in the configuration of a strapless brassiere, with a front brassiere portion having brassiere cups, according to a third embodiment.
Figure 30:
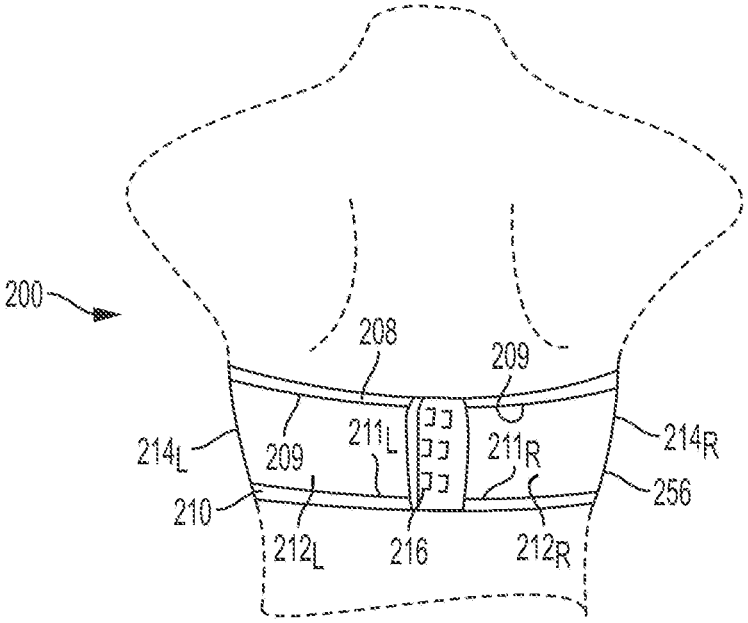
FIG. 30 is a rear elevational view of the strapless brassiere of FIG. 29 with brassiere cups, according to the third embodiment.

FIG. 29 illustrates a front view of a garment in the configuration of a strapless brassiere 200 according to at least a third embodiment of the present disclosure. FIG. 30 illustrates a rear view of the strapless brassiere 200 of FIG. 29. The strapless brassiere 200 may comprise cups 202 comprising at least partially overlapping material layers as described further with reference to FIGS. 31 through 43. As illustrated in FIG. 29, the cups 202 may comprise an upper peripheral edge 204 and a lower peripheral edge 206 coupled to an upper banding 208 and a lower banding 210, respectively. The upper peripheral edge 204 and the lower peripheral edge 206 may extend between lateral peripheral edges 214 of the strapless brassiere 200. Each of the lateral peripheral edges 214 may be proximate to an arm of the wearer. The lower peripheral edge 206 may extend under the breasts of the wearer. A midline seam 218 may be provided near a medial centerline 220 of the strapless brassiere 200, proximate to a sternum or midline of the wearer, to define separate cups 202, i.e., a left-side cup $\mathbf{202}_L$ and a right-side cup $\mathbf{202}_R$. The upper peripheral edge 204, the lateral peripheral edge 214, the lower peripheral edge 206, and the medial centerline 220 define the peripheral edges of the cup 202. The medial centerline 220 may be otherwise referred to herein as the "medial side edge" of the cup 202.

The cups 202 may be coupled to a back band 212 along the lateral peripheral edges 214. The upper banding 208 and the lower banding 210 may continue along an upper peripheral edge 209 and a lower peripheral edge 211, respectively, of the adjustable back band 212 to extend around the torso of the wearer. The upper banding 208 and the lower banding 210 may comprise a stretchable (i.e., elastic) material. In some embodiments, the upper banding 208 (in front and back) and/or the upper peripheral edges 204, 209 may comprise loops configured to receive hooks of selectively removable and/or re-configurable shoulder straps. The back band 212 may be adjustable, e.g., including a closure mechanism such as hook-and-eye back closures 216, a zipper, lacing, or the like, to secure the strapless brassiere 200 around the wearer. In other embodiments, the back band 212 may lack a closure mechanism. For example, the back band 212 may be a singular component spanning the back of the wearer and comprise an elastic material configured to secure the strapless brassiere 200 around the wearer.

Figure 31:
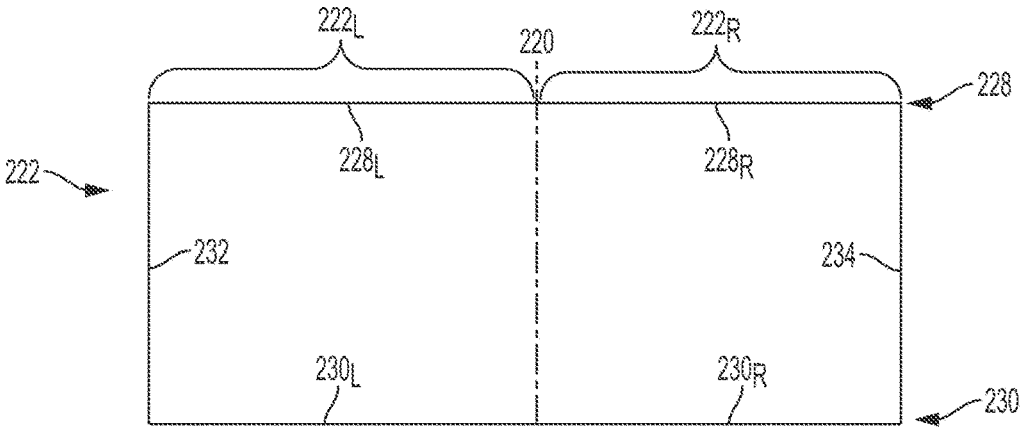
FIG. 31 is a rear elevational view of a first material layer of the brassiere cups of the strapless brassiere of FIGS. 29 and 30, according to the third embodiment.
Figure 32:
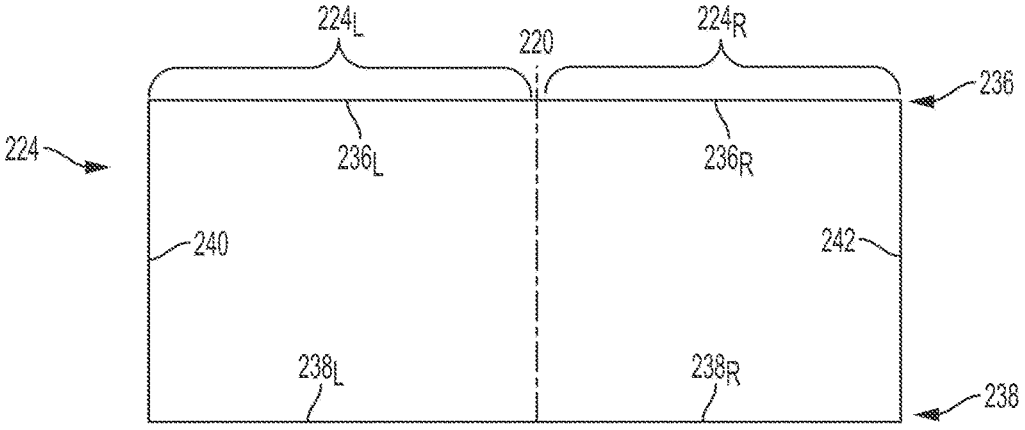
FIG. 32 is a rear elevational view of a second material layer of the brassiere cups of the strapless brassiere of FIGS. 29 through 31, according to the third embodiment.
Figure 33:
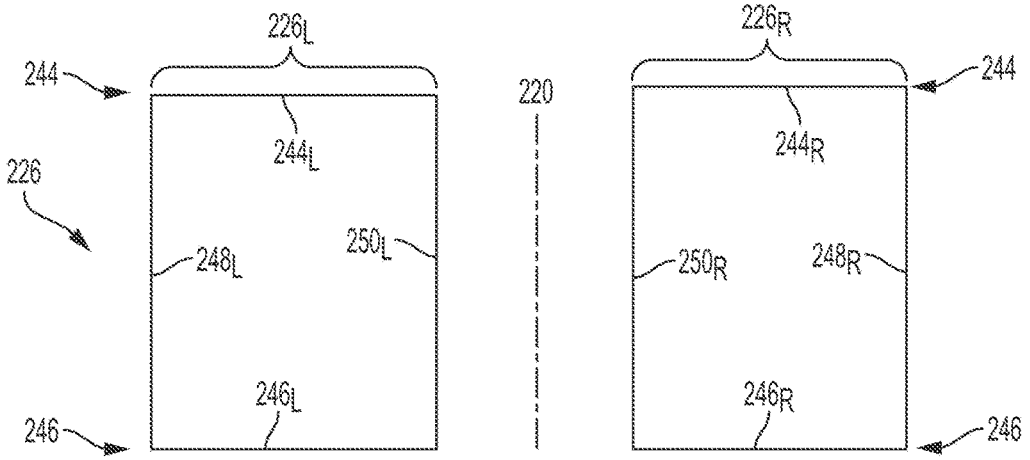
FIG. 33 is a rear elevational view of a third material layer of the brassiere cups of the strapless brassiere of FIGS. 29 through 32, according to the third embodiment.

Each cup 202 of the strapless brassiere 200 may comprise a plurality of at least partially overlapping material layers. The cup 202 may comprise a first material layer 222, such as a top (i.e., outermost) material layer (FIG. 31); a second material layer 224, such as a middle material layer (FIG. 32); and a third material layer 226, such as a bottom (i.e., innermost) material layer (FIG. 33). With reference to FIGS. 31 to 33, in some embodiments, the left-side first material layer $\mathbf{222}_L$ and the right-side first material layer $\mathbf{222}_R$ may be portions of the same unitary, continuous panel of material, as illustrated in FIG. 31. Likewise, in some embodiments, the left-side second material layer $\mathbf{224}_L$ and the right-side second material layer $\mathbf{224}_R$ may be portions of the same unitary, continuous panel of material, as illustrated in FIG. 32. The midline seam 218 (FIG. 29) may be provided, along the medial centerline 220 of the strapless brassiere 200, to define separate left-side and right-side cups $\mathbf{202}_L$, $\mathbf{202}_R$ (FIG. 29), respectively.

In other embodiments, the left- and right-side first material layers $\mathbf{222}_L$, $\mathbf{222}_R$ may be formed by joining (e.g., stitching together, at seam 218 (FIG. 29)) two initially-separate panels of material, and the left- and right-side second material layers $\mathbf{224}_L$, $\mathbf{224}_R$ may be formed by joining (e.g., stitching together, at seam 218 (FIG. 29)) another two initially-separate panels of material.

Though the figures illustrate only one seam forming the seam 218 (FIG. 29) along the medial centerline 220, in other embodiments, more than one seam may be provided, defining a distinct region about the medial centerline 220 separating the left-side cup $\mathbf{202}_L$ (FIG. 29) from the right-side cup $\mathbf{202}_R$ (FIG. 29).

In some embodiments, the seam 218 (FIG. 29) may not be included such that the left-side cup $\mathbf{202}_L$ and the right-side cup $\mathbf{202}_R$ may not be distinctly defined along the medial centerline 220. In such embodiments, the left-side cup $\mathbf{202}_L$ and the right-side cup $\mathbf{202}_R$ form a unitary and seamless region extending between the lateral peripheral edges 214 of the strapless brassiere 200. Such a strapless brassiere may be referred to in the art as strapless brassiere 200 configured as a "tube top."

With returned reference to the embodiment of FIG. 29, the strapless brassiere 200 may have an appearance akin to the appearance of a conventional strapless brassiere. The strapless brassiere 200 may be configured such that each of the first material layer 222, the second material layer 224, and the third material layer 226 of each cup 202 cover and conceal the nipple and the majority of the breast when the material layers 222, 224, 226 are in a disengaged configuration and not being stretched, as illustrated in FIG. 29. Accordingly, the strapless brassiere 200 may be worn in the same manner as a conventional strapless brassiere, e.g., for long periods of time, as an undergarment, or may be configured as outerwear.

FIGS. 31 through 33 illustrate rear views of each material layer for the left-side and right-side cups $\mathbf{202}_L$, $\mathbf{202}_R$, respectively. The first material layer 222 may comprise an upper peripheral edge 228 (that aligns with the upper peripheral edge 204 (FIG. 29) of the strapless brassiere 200) and a lower peripheral edge 230 (that may align with or be disposed longitudinally above the lower peripheral edge 206 (FIG. 29) of the strapless brassiere 200). The upper peripheral edge 228 and the lower peripheral edge 230 each extend between a left lateral peripheral edge 232 (that may align with the majority of the left-side lateral peripheral edge $\mathbf{214}_L$ (FIG. 29) of the strapless brassiere 200) and a right lateral peripheral edge 234 (that may align with the majority of the right-side lateral peripheral edge $\mathbf{214}_R$ (FIG. 29) of the strapless brassiere 200). The first material layer 222 may extend from the upper peripheral edge 204 (FIG. 29) toward the lower peripheral edge 206 (FIG. 29) of the strapless brassiere 200. In some embodiments, the lower peripheral edge 230 of the first material layer 222 may align with the lower peripheral edge 206 (FIG. 29) of the strapless brassiere 200. In other embodiments, the lower peripheral edge 230 may be disposed longitudinally above the lower peripheral edge 206 (FIG. 29) of the strapless brassiere 200, as illustrated in FIG. 29. The first material layer 222 may be made of a first material that may be decorative, to add to the aesthetics of the cups 202 when included in the strapless brassiere 200.

The second material layer 224 may comprise an upper peripheral edge 236 (that may be disposed longitudinally below the upper peripheral edge 204 (FIG. 29) of the strapless brassiere 200, or, alternatively, that may align with the upper peripheral edge 204) and a lower peripheral edge 238 (that may align with the lower peripheral edge 206 (FIG. 29) of the strapless brassiere 200). The upper peripheral edge 236 and the lower peripheral edge 238 may extend between a left lateral peripheral edge 240 (that may align with the majority of the left-side lateral peripheral edge $\mathbf{214}_L$ (FIG. 29) of the strapless brassiere 200) and a right lateral peripheral edge 242 (that may align with the majority of the right-side lateral peripheral edge $\mathbf{214}_R$ (FIG. 29) of the strapless brassiere 200). The second material layer 224 may extend from the lower peripheral edge 206 (FIG. 29) toward the upper peripheral edge 204 (FIG. 29) of the strapless brassiere 200. In some embodiments, the upper peripheral edge 236 of the second material layer 224 may align with the upper peripheral edge 204 (FIG. 29) of the strapless brassiere 200. In other embodiments, the upper peripheral edge 236 of the second material layer 224 may be disposed longitudinally below the upper peripheral edge 204 (FIG. 29) of the strapless brassiere 200.

In some embodiments, the upper peripheral edge 228 of the first material layer 222 and the upper peripheral edge 236 of the second material layer 224 may have substantially the same length. The lower peripheral edge 230 of the first material layer 222 and the lower peripheral edge 238 of the second material layer 224 may have substantially the same length.

The second material layer 224 may be made of the first material used to construct the first material layer 222 so that, when viewed in the constructed strapless brassiere 200 (FIG. 29), the exteriorly-visible materials visually appear substantially similar. In other embodiments, the second material layer 224 may be made of a second material different from the first material.

With reference to FIG. 33, the third material layer 226, or, rather, each of the left-side third material layer $\mathbf{226}_L$ and the right-side third material layer $\mathbf{226}_R$, may comprise an upper peripheral edge 244 (that may align with the upper peripheral edge 204 (FIG. 29) of the strapless brassiere 200) and a lower peripheral edge 246 (that may align with the lower peripheral edge 206 (FIG. 29) of the strapless brassiere 200). The upper peripheral edge 244 and the lower peripheral edge 246 of each of the left- and right-side third material layers $\mathbf{226}_L$, $\mathbf{226}_R$ may extend between a lateral peripheral edge 248 (that may align with the lateral peripheral edge 214 (FIG. 29) of the strapless brassiere 200) and a medial peripheral edge 250. The third material layer 226 may extend from the lateral peripheral edge 214 (FIG. 29) toward the medial centerline 220 of the strapless brassiere 200. The medial peripheral edge 250 is disposed laterally between the medial centerline 220 of the strapless brassiere 200 and a longitudinal centerline 251 (FIG. 34) of the cup 202 (FIG. 29). Thus, the third material layer 226 extends to cover a majority of the width of the breast. The third material layer 226 may be made of either the first material, the second material, or a third material different from either of the first material or the second material.

Each of the material layers 222, 224, 226 may have a rectangular, or substantially rectangular, shape defined by straight, or substantially straight, edges. As used herein "rectangular" includes both a shape in which vertical sides have longer or shorter lengths than horizontal sides as well as a square shape in which the vertical sides and the horizontal sides are all of equal lengths. Forming the material layers 222, 224, 226 in such straight-edged, rectangular shapes may enable fabrication of the strapless brassiere 200 with improved simplicity in fabric cutting and fabric construction (e.g., stitching), as well as less waste of remainder material. That is, a panel of fabric can be more easily cut into a number of rectangular pieces, with no wasted material, as compared to trying to cut curved-edge pieces from the panel of fabric, as with many conventional brassieres. Further, stitching together straight edges of straight-edged, rectangular shapes may be easier and therefore faster and likely more consistently accomplished, as compared to joining curved-edge pieces in many conventional brassieres.

Figure 34:
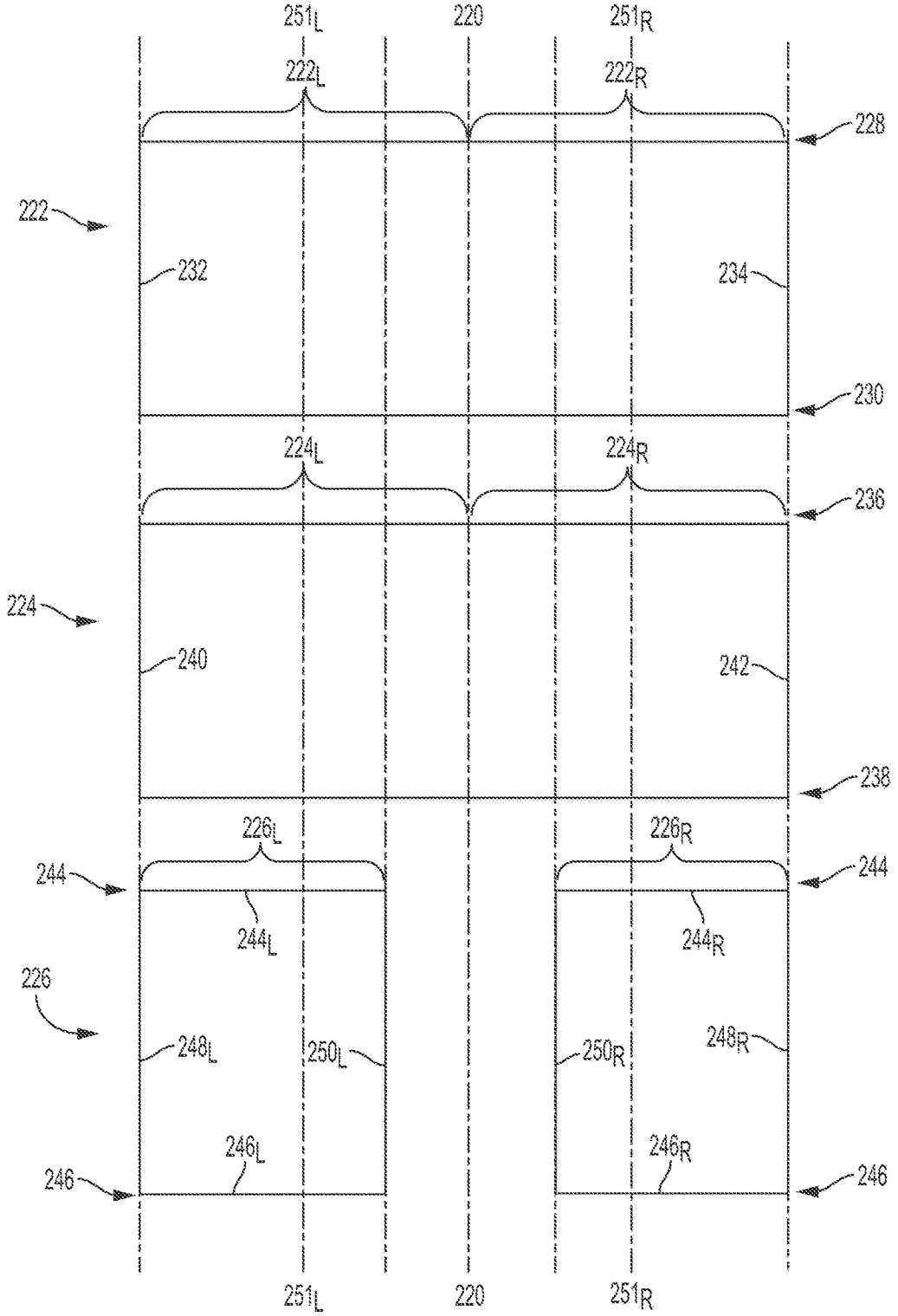
FIG. 34 is an exploded view of the rear side of the material layers of the brassiere cups of the strapless brassiere of FIGS. 29 through 33, according to the third embodiment.

FIG. 34 illustrates an exploded view of the three material layers 222, 224, 226 of the strapless brassiere 200 as they are arranged to at least partially overlap one another. The dotted-dashed lines show approximate latitudinal alignment of the three material layers 222, 224, 226.

Figure 35:
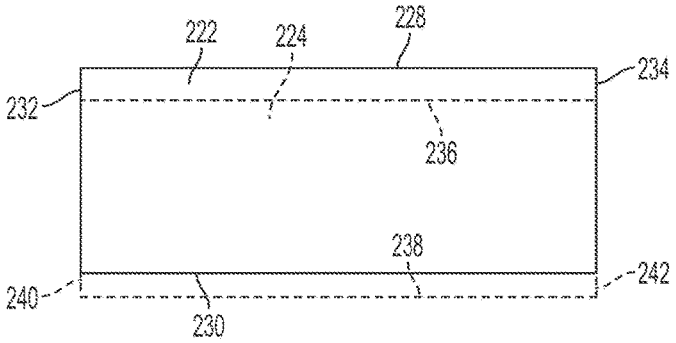
FIG. 35 is a rear elevational view of the second material layer, shown in dashed line, overlapping the first material layer of the brassiere cups of the strapless brassiere of FIGS. 29 through 34, according to the third embodiment.
Figure 36:
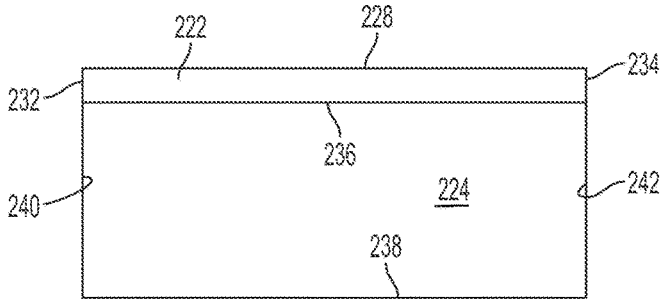
FIG. 36 is a rear elevational view of the second material layer overlapping the first material layer of the brassiere cups of the strapless brassiere of FIGS. 29 through 35, according to the third embodiment.

FIGS. 35 and 36 illustrate the alignment of each edge of the first material layer 222 and the second material layer 224 from a rear view of the brassiere 200 (FIG. 29). The edges of the second material layer 224 are illustrated as dashed lines in FIG. 35 and as solid lines in FIG. 36. The first material layer 222 and the second material layer 224 may overlap such that the left and right lateral peripheral edges 232, 234 of the first material layer 222 align with the left and right lateral peripheral edges 240, 242 of the second material layer 224, respectively. Each of the upper and lower peripheral edges 228, 230, 236, 238 may be parallel to one another. In some embodiments, the lower peripheral edge 238 of the second material layer 224 may be disposed longitudinally below the lower peripheral edge 230 of the first material layer 222, such that when the constructed cup 202 (FIG. 29) is viewed from the front, the second material layer 224 may be at least partially exteriorly-visible, as illustrated in FIG. 29. In other embodiments, the lower peripheral edge 230 of the first material layer 222 and the lower peripheral edge 238 of the second material layer 224 may be coextensive and align with one another, such that the second material layer 224 may not be exteriorly visible when the strapless brassiere 200 is viewed from the front. The upper peripheral edge 236 of the second material layer 224 may be recessed from the upper peripheral edge 228 of the first material layer 222, as illustrated in FIG. 36. Alternatively, in some embodiments, the upper peripheral edge 236 of the second material layer 224 may be coextensive and align with the upper peripheral edge 228 of the first material layer 222.

Figure 37:
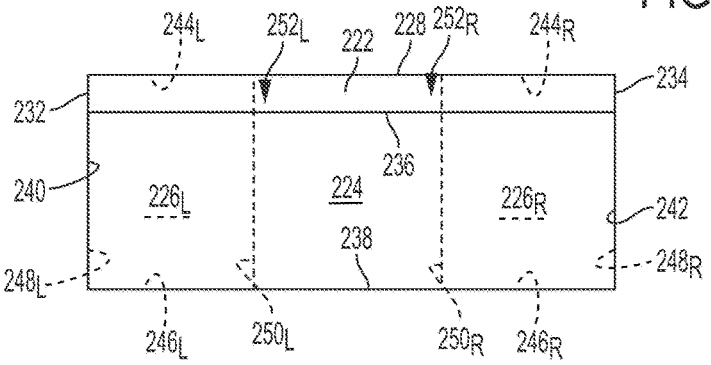
FIG. 37 is a rear elevational view of the third material layer, shown in dashed line, overlapping the first material layer and the second material layer of the brassiere cups of the strapless brassiere of FIGS. 29 through 36, according to the third embodiment.
Figure 38:
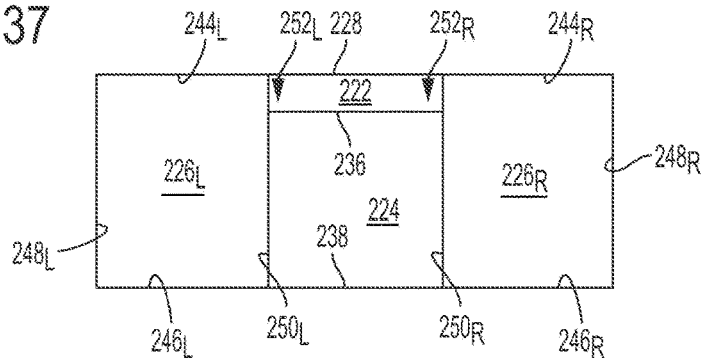
FIG. 38 is a rear elevational view of the third material layer overlapping the second material layer and the first material layer of the brassiere cups of the strapless brassiere of FIGS. 29 through 37, according to the third embodiment.

FIGS. 37 and 38 illustrate the alignment of each edge of the three material layers 222, 224, 226. The edges of the third material layer 226 are illustrated as dashed lines in FIG. 37 and as solid lines in FIG. 38. The third material layer 226 may at least partially overlap each of the first material layer 222 and the second material layer 224. The upper peripheral edge 244 of the third material layer 226 may align with the upper peripheral edge 228 of the first material layer 222. The lower peripheral edge 246 of the third material layer 226 may align with the lower peripheral edge 238 of the second material layer 224. The medial peripheral edge 250 of the third material layer 226 may overlap with and cross over the upper peripheral edge 236 of the second material layer 224, defining a nook 252. The first material layer 222 may at least partially overlap the nook 252, such that the nook 252 is not visible from a front view when the strapless brassiere 200 is in a disengaged configuration, as illustrated in FIG. 29. The nook 252 may defined with its mouth defined at at least one of the peripheral edges of the cup 202 (FIG. 29). For example, the nook 252 may be defined with its mouth along an upper portion of the medial centerline 220 (FIG. 34) and, optionally, also along a medial portion of the upper peripheral edge 244.

The nook 252 may be substantially V-shaped. For example, the nook 252 may be substantially L-shaped. As used herein, the term "L-shaped" means and includes a shape defined by two sides meeting at a point and defining an angle of 90° or about 90°.

The first material layer 222 may at least partially overlap the nook 252 (e.g., may fully overlap the nook 252), such that the nook 252 is not exteriorly visible from a front view of the cup 202 in the disengaged configuration illustrated in FIG. 29. The covering of the nook 252 by the first material layer 222, in the disengaged configuration illustrated in FIG. 38, may define a substantially rectangular shape formed by, for example, the medial peripheral edge 250 of the third material layer 226, the upper peripheral edge 236 of the second material layer 224, the upper peripheral edge 228 of the first material layer 222, and the medial centerline 220 (FIG. 34) or the midline seam 218 (FIG. 29).

Figure 39:
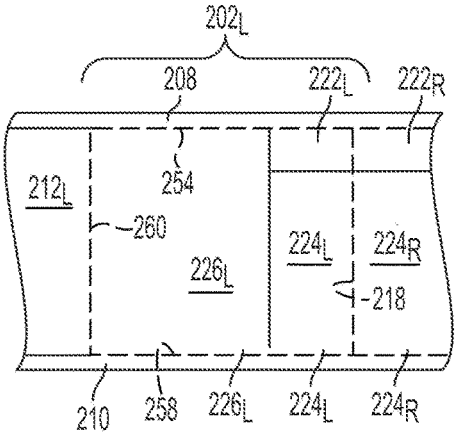
FIG. 39 is a partial, rear elevational view of the left-side brassiere cup incorporated within the strapless brassiere of FIGS. 29 through 38, according to the third embodiment.
Figure 40:
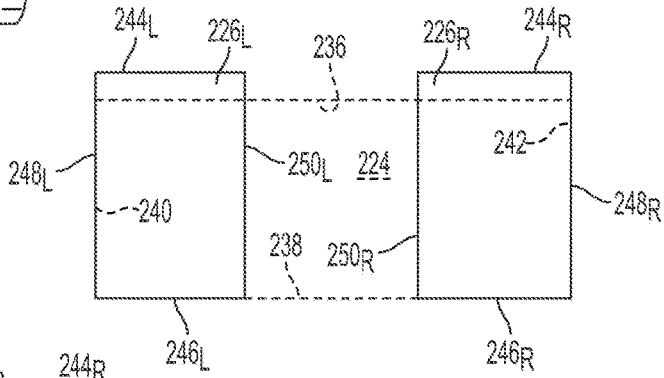
FIG. 40 is a front elevational view of the second material layer, shown in dashed line, overlapping the third material layer of the brassiere cups of the strapless brassiere of FIGS. 29 through 39, according to the third embodiment.
Figure 41:
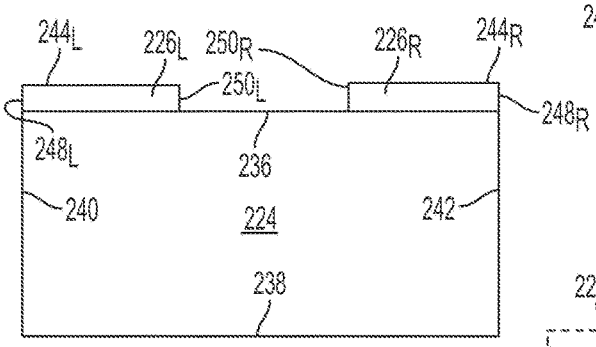
FIG. 41 is a front elevational view of the second material layer overlapping the third material layer of the brassiere cups of the strapless brassiere of FIGS. 29 through 40, according to the third embodiment.
Figure 42:
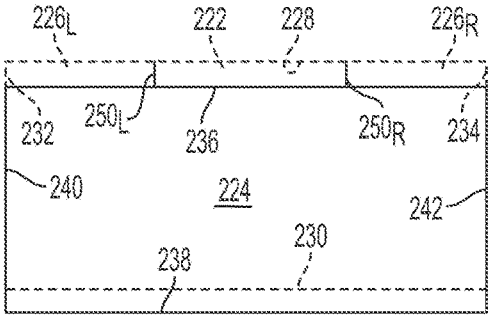
FIG. 42 is a front elevational view of the first material layer, shown in dashed line, overlapping the second material layer and the third material layer of the brassiere cups of the strapless brassiere of FIGS. 29 through 41, according to the third embodiment.
Figure 43:
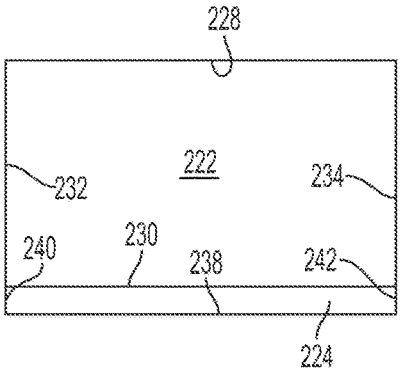
FIG. 43 is a front elevational view of the first material layer overlapping the second material layer and the third material layer of the brassiere cups of the strapless brassiere of FIGS. 29 through 42, according to the third embodiment.
Figure 44:
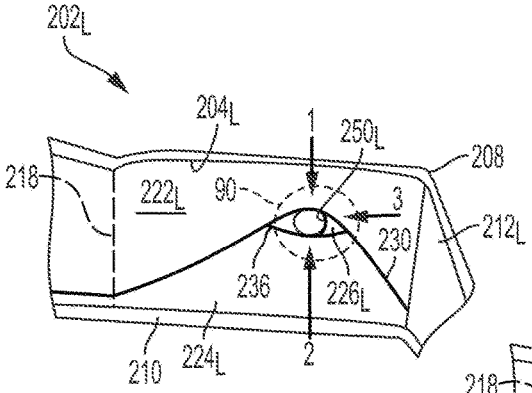
FIG. 44 is a partial, front elevational view of the strapless brassiere of FIGS. 29 through 43, incorporating the left-side brassiere cup according to the third embodiment, and a mirror view of a partial, front elevational view of the strapless brassiere of FIGS. 29 through 43, incorporating the right-side brassiere cup according to the third embodiment, with the funnel of the breast pump received in the cup and located in a first position.
Figure 45:
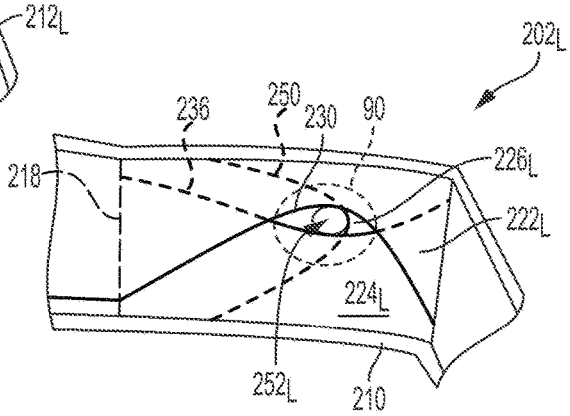
FIG. 45 is a partial, front elevational view of the strapless brassiere of FIGS. 29 through 44, incorporating the left-side brassiere cup according to the third embodiment, and a mirror view of a partial, front elevational view of the strapless brassiere of FIGS. 29 through 44, incorporating the right-side brassiere cup according to the third embodiment, with the funnel of the breast pump received in the cup and located in the first position, with some hidden edges of the second material layer and the third material layer in dashed line.
Figure 46:
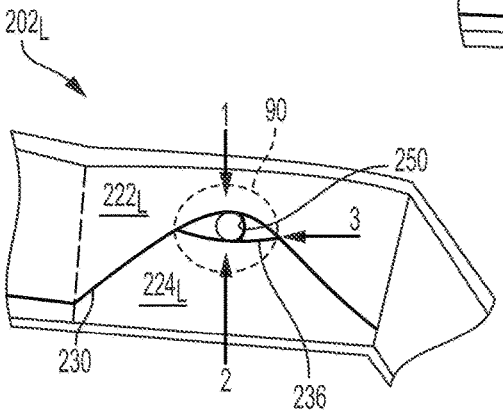
FIG. 46 is a partial, front elevational view of the strapless brassiere of FIGS. 29 through 45, incorporating the left-side brassiere cup according to the third embodiment, and a mirror view of a partial, front elevational view of the strapless brassiere of FIGS. 29 through 45, incorporating the right-side brassiere cup according to the third embodiment, with the funnel of the breast pump received in the cup and located in a second position.
Figure 47:
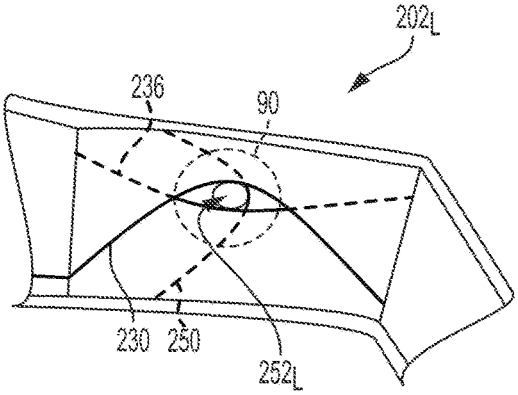
FIG. 47 is a partial, front elevational view of the strapless brassiere of FIGS. 29 through 46, incorporating the left-side brassiere cup according to the third embodiment, and a mirror view of a partial, front elevational view of the strapless brassiere of FIGS. 29 through 46, incorporating the right-side brassiere cup according to the third embodiment, with the funnel of the breast pump received in the cup and located in the second position, with some hidden edges of the second material layer and the third material layer in dashed line.

FIG. 39 illustrates a partial back view of the left-side brassiere cup $\mathbf{202}_L$ incorporated into the strapless brassiere 200 (FIG. 29). A first seam 254 may join the first material layer 222 and the third material layer 226 along the respective upper peripheral edge 228, 244 (FIGS. 35 through 38) thereof, which may collectively form attached edges of the upper peripheral edge 204 (FIG. 29) of the cups 202. A second seam 256 (FIG. 30) may join the first material layer 222, the second material layer 224, and the third material layer 226 along the respective right lateral peripheral edges 234, 242, 248 (FIGS. 35 through 38) thereof, which may collectively form attached edges of the right-side lateral peripheral edge $\mathbf{214}_R$ of the right-side cup $\mathbf{202}_R$. A third seam 258 may join the second material layer 224 and the third material layer 226 along the respective lower peripheral edge 238, 246 (FIGS. 35 through 38) thereof, which may collectively form attached edges of the lower peripheral edge 206 (FIG. 29) of the cups 202. A fourth seam 260 may join the first material layer 222, the second material layer 224, and the third material layer 226 along the respective left lateral peripheral edge 232, 240, 248 (FIGS. 35 through 38) thereof, which may collectively form attached edges of the left-side lateral peripheral edge $\mathbf{214}_L$ of the left-side cup 202. Each of the second seam 256 (FIG. 30) and the fourth seam 260 may join the respective lateral peripheral edges 214 to adjustable back bands 212. In construction, the upper peripheral edges 228, 244 (FIGS. 35 through 38) of the first and third material layers 222, 226 may be joined to the upper banding 208, and the lower peripheral edges 238, 246 (FIGS. 35 through 38) of the second and third material layers 224, 226 (FIGS. 35 through 38) may be joined to the lower banding 210.

Further, in construction, the lower peripheral edge 230 of the first material layer 222, the upper peripheral edge 236 of the second material layer 224, and the medial peripheral edge 250 of the third material layer 226 may be left at least partially unattached or unconnected to another material layer of the cups 202, defining free edges of the cups 202. The upper peripheral edge 236 and the medial peripheral edge 250 may at least partially define the nook 252 into which the funnel 90 (FIG. 21) of the breast pump 92 (FIG. 21) may be received when the cup 202 (FIG. 29) is in the pumping configuration.

With returned reference to FIG. 29 and FIGS. 35 through 38, the medial peripheral edges 250 of the third material layer 226—which edges may be free edges—may extend vertically between the upper peripheral edge 204 and the lower peripheral edge 206 of the cup 202. The medial peripheral edge 250 of the third material layer 226 may be a substantially straight edge extending substantially parallel to the medial centerline 220 of the brassiere 200. The upper peripheral edge 236 of the second material layer 224—which may be a free edge—may extend horizontally between the lateral peripheral edge 214 of the cup 202 and the medial centerline 220 (FIG. 34) of the cup 202. The lower peripheral edge 230 of the first material layer 222—which may be a free edge—may extend horizontally between the lateral peripheral edge 214 of the cup 202 and the medial centerline 220 (FIG. 34) of the cup 202. The upper peripheral edge 236 and the lower peripheral edge 230 may be substantially straight edges extending substantially parallel to each other and to the upper peripheral edge 204 and lower peripheral edge 206 of the strapless brassiere 200.

The material of the material layers 222, 224, 226 of the strapless brassiere 200 and/or the material of the free edges (i.e., edges 230, 236, 250) may be any of that described above with regard to the material layers and free edges of the embodiments of FIGS. 1 through 25.

While the back views of the overlapping material layers of the strapless brassiere 200 are illustrated in FIGS. 31 through 39, FIGS. 40 through 47 illustrate the front views of the material layers 222, 224, and 226.

Figure 48:
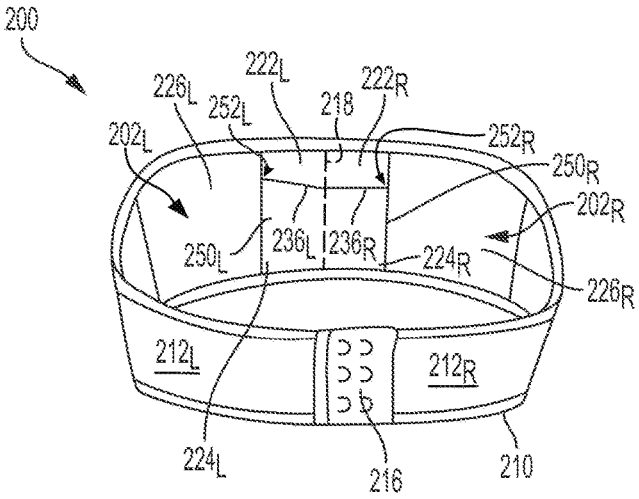
FIG. 48 is a perspective, rear view of the strapless brassiere of FIGS. 29 through 47, with the front brassiere portion having brassiere cups according to the third embodiment.

FIGS. 44 through 47 illustrate a front view of a left-side cup $\mathbf{202}_L$ of the strapless brassiere 200 configured to receive the funnel 90. FIG. 48 illustrates a rear view of the strapless brassiere 200. The free edges of the second material layer 224 and the third material layer 226 (i.e., edges 236, 250) are shown as dashed lines in FIGS. 45 and 47 where the free edge of the second material layer 224 (i.e., edge 236) and of the third material layer 226 (i.e., edge 250) are hidden from view by the first material layer 222 or the second material layer 224. Each of the free edges (i.e., edges 230, 236, 250) of the material layers 222, 224, 226 may be configured to support the funnel 90 of the breast pump 92 (FIG. 21) against the nipple of the breast and to prevent the funnel 90 from moving out of place in the same manner as the free edges of the embodiments of FIGS. 22 through 25.

With returned reference to the first embodiment of the brassiere of the garments of FIGS. 1 through 20 and 22 through 28, and as discussed above, the lateral upper edge 60 extends straightly, or substantially straightly, from the upper point of the lateral side edge 58 to the upper point of the medial side edge 64. According to another embodiment, illustrated in FIG. 49, a second material layer 44' may have a lateral upper edge $\mathbf{60}_L$' that extends from the upper point of the lateral side edge 58 in partial alignment with the lateral upper edge 50 of the first material layer 42 and in partial alignment with the lateral upper edge 70 of the third material layer 46. An upper edge 61 may extend from the lateral upper edge $\mathbf{60}_L$' to the upper point of the medial side edge 64. The upper edge 61 may be a straight, or substantially straight, edge, and the upper edge 61 may be a free edge (e.g., the only free edge) of the edges 58, 60', 61, 64, 66 of the second material layer 44'. Thus, the upper edge 61 may extend substantially horizontally, perpendicular to the longitudinal centerline 63 (FIG. 9) of the cup 12. A nook may be defined in part by the medial side edge 74 of the third material layer 46 and by the upper edge 61 of the second material layer 44'. The nook (not illustrated) may be an L-shaped nook. The upper edge 61 may function to support the funnel 90 (FIG. 21) in substantially the same manner as the lateral upper edge 60 (FIGS. 22-25). The second material layer 44' may be sized and shaped to cover a majority of the breast when the brassiere is in a disengaged configuration. Thus, the upper edge 61 may be positioned above the nipple of the wearer's breast.

Figure 50:
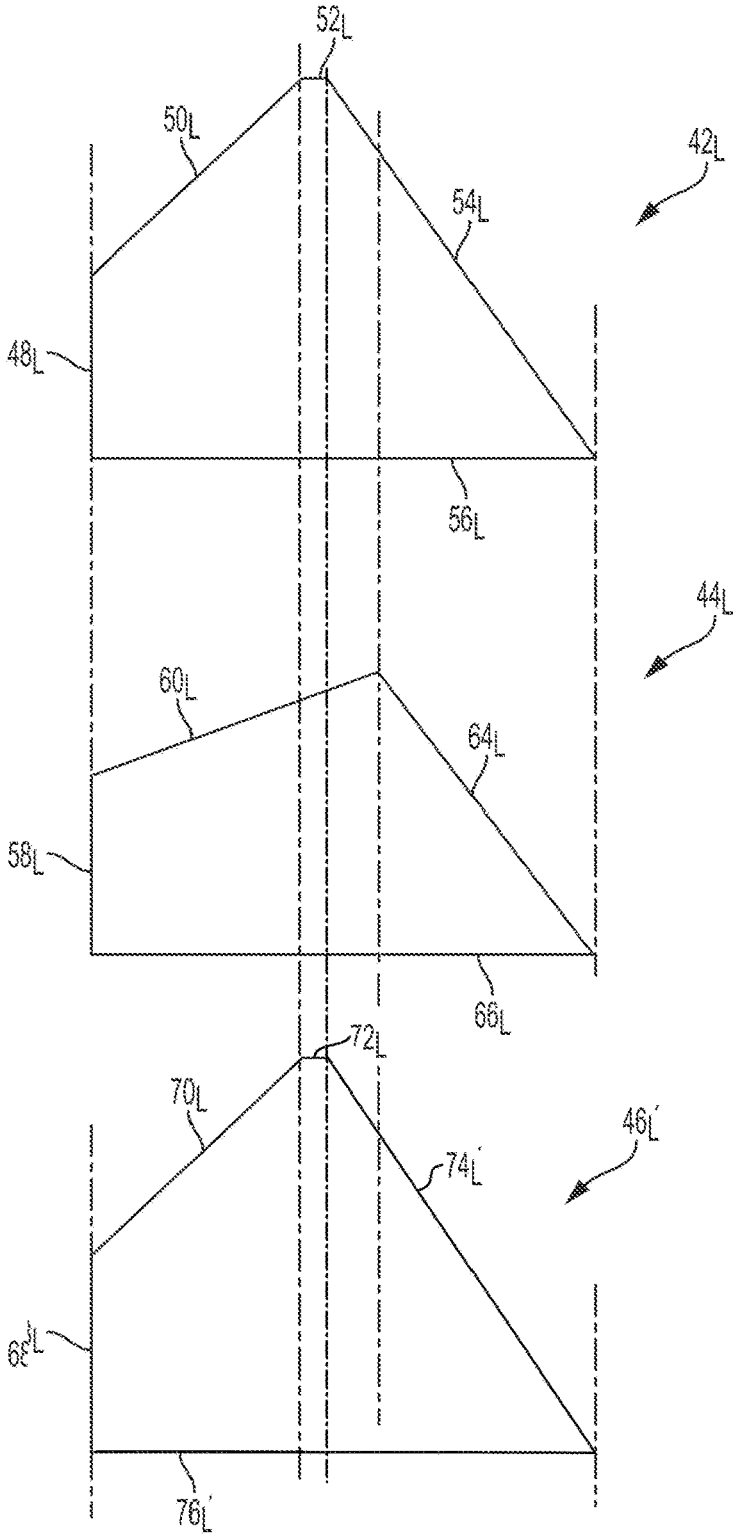
FIG. 50 is an exploded view of the rear sides of the material layers of a left-side brassiere cup, and is a mirror view of an exploded view of the rear sides of the material layers of a right-side brassiere cup, of a front brassiere portion of a garment, the front brassiere portion having brassiere cups according to a fifth embodiment of the present disclosure.

According to another embodiment, illustrated in FIG. 50, a third material layer 46' may have a medial side edge 74' that extends at an angle from the medial-most point of the clasp attachment edge 72 and to or toward a lower edge 76'. Thus, the lower edge 76' may be longer than the lower edge 76 (FIG. 6) of the third material layer 46 (FIG. 6) of the embodiment of FIGS. 1 through 20 and 22 through 28. The medial side edge 74' may be straight or substantially straight. Further, the medial side edge 74' may be a free edge (e.g., the only free edge) of the third material layer 46', and the medial side edge 74' may function to support the funnel 90 in substantially the same manner that the medial side edge 74 (FIG. 6) functions to support the funnel 90.

In some embodiments, the medial side edge 74' may be shaped and positioned, relative to the medial side edge 54 of the first material layer 42 such that first material layer 42 extends medially past the medial side edge 74' of the third material layer 46'. Therefore, at least a portion of the medial side edge 74' and at least a portion of the lateral upper edge 60 may define a nook that is covered by the first material layer 42 in the disengaged configuration. In other embodiments, the medial side edge 74' may wholly or substantially align with the medial side edge 54 such that a nook may be defined upon the medial side edge 74' being moved laterally from its disengaged configuration. Thus, the third material layer 46' may cover a majority of the breast when in the disengaged configuration.

Figure 51:
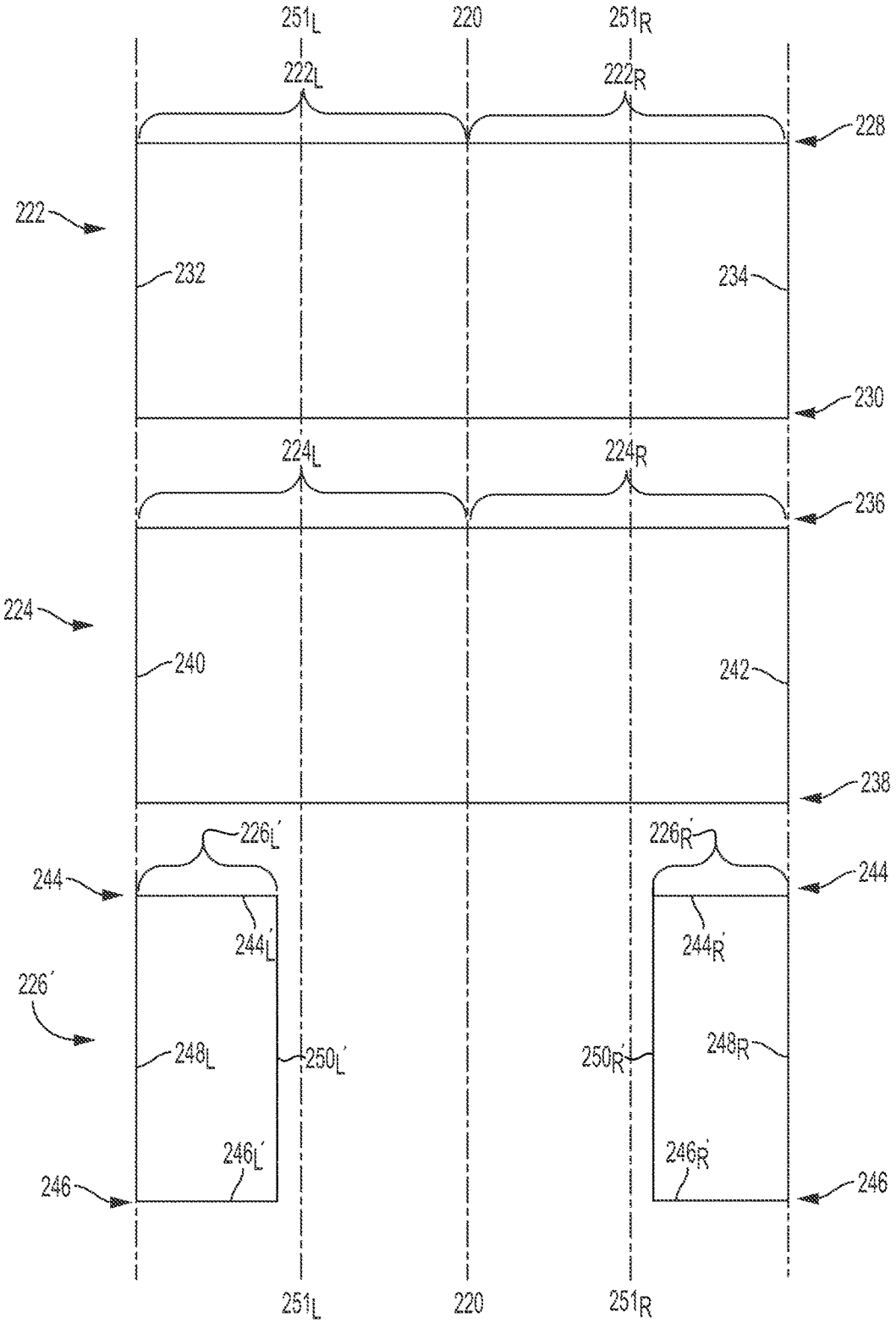
FIG. 51 is an exploded view of the rear side of the material layers of brassiere cups of a strapless brassiere, according to a sixth embodiment.

With reference to FIG. 51, according to another embodiment of a strapless brassiere, a third material layer 226' may be thinner than the third material layer 226 (FIG. 34) of the embodiment of FIGS. 29 through 48. A medial peripheral edge 250', extending between an upper peripheral edge 244' and a lower peripheral edge 246', may be laterally disposed to the longitudinal centerline 251 of the cup of the brassiere. The medial peripheral edge 250' nonetheless defines a nook (e.g., nook 252 (FIG. 38)) with the upper peripheral edge 236 of the second material layer 224. The medial peripheral edge 250' provides a free edge of the third material layer 226'. Thus, the medial peripheral edge 250' functions substantially similarly to the medial peripheral edge 250 (FIG. 34) for supporting the funnel 90 (FIG. 21) from the horizontal, medial direction. However, the third material layer 226' has a width that does not cover a majority of the breast. With the medial peripheral edge 250' lateral to the longitudinal centerline 251, the panels of the third material layer 226' may provide shape support, of the garment, when in the disengaged configuration as well as support for the funnel 90 when the garment is in the pumping configuration.

Accordingly, the angles, lengths, widths, and dispositions of the peripheral straight, or substantially straight, edges of the material layers of the front brassiere portion may be otherwise configured to leave at least one edge forming, at least in part, a free edge of each of a plurality of at least partially overlapping material layers, at least two of which are positioned to define a nook, whether in the disengaged configuration or at least in a pumping configuration, and which nook is overlapped or overlappable by an outermost material layer (e.g., the first material layer 42, 222).

Figure 49:
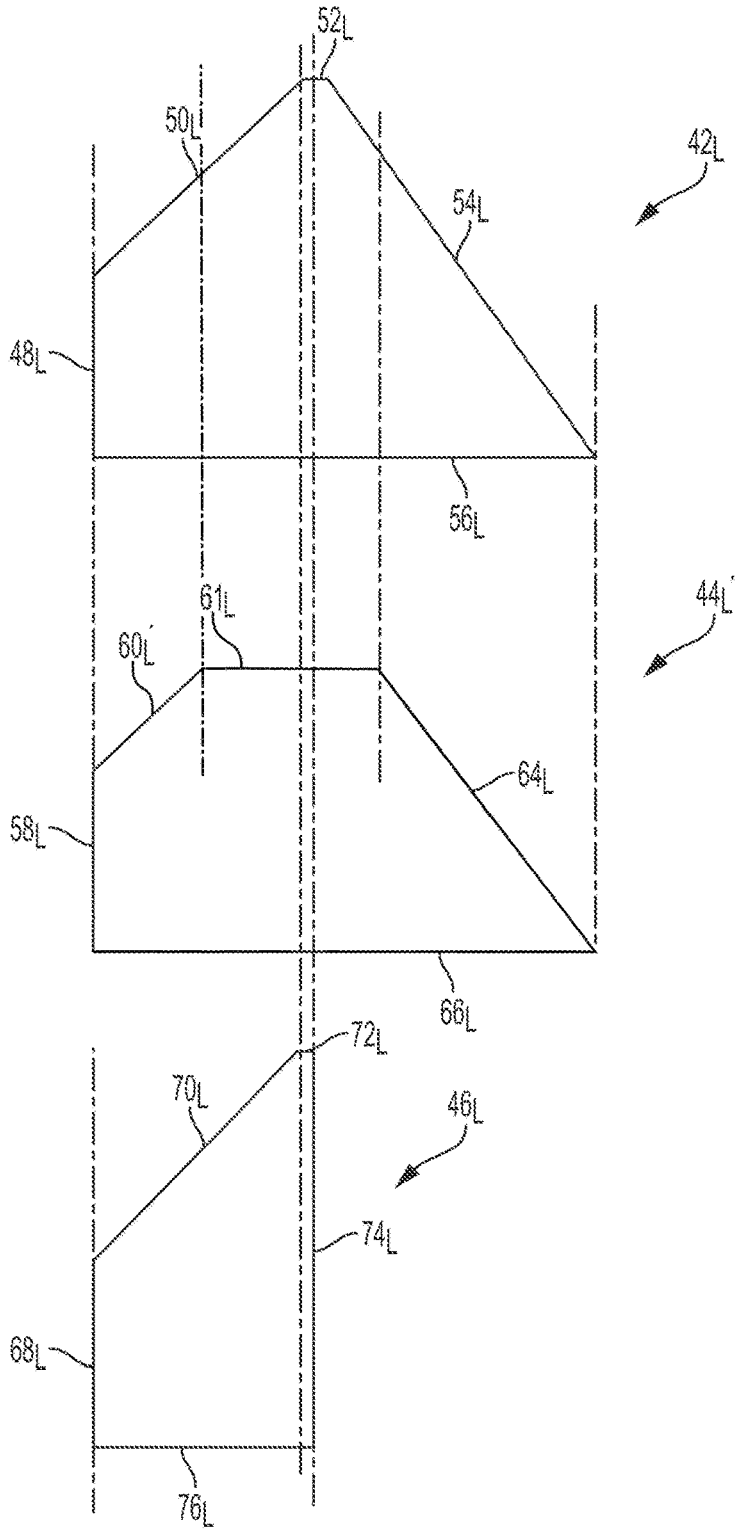
FIG. 49 is an exploded view of the rear sides of the material layers of a left-side brassiere cup, and is a mirror view of an exploded view of the rear sides of the material layers of a right-side brassiere cup, of a front brassiere portion of a garment, the front brassiere portion having brassiere cups according to a fourth embodiment of the present disclosure.

Thus, in the embodiments of the strapless brassiere 200 of FIGS. 44 through 48 or FIG. 51, as well as in the embodiments of the brassiere 10 of FIGS. 1 through 20 and 22 through 28 (with or without the front or back overlays 101, 118 of the embodiment of FIGS. 26 through 28 and whether with brassiere cups having the material layers 42, 44, 46 of the embodiment of, for example, FIG. 6; the material layers 42, 44', 46 of the embodiment of, for example, FIG. 49; or the material layers 42, 44, 46' of, for example, FIG. 50), the configuration and elasticity of the overlapping material layers of the cups 12, 202 may enable a wearer to support the funnel 90 against her nipple, hands free, regardless of whether the nipple is located in the exact center of the breast or is offset somewhat. The elasticity of the material of the material layers and components of the brassiere 10, 200 enable the funnel 90 to be selectively shifted by the wearer proximate to a center of the cup 12, 202. Regardless of where, in this region, the funnel 90 is shifted by the wearer, the funnel 90 will retain support from the multiple directions of force (arrows 1 through 3). Nonetheless, the nooks 78, 252 defined by the overlapping free edges (e.g., edges 56, 60, 74 (FIG. 6); edges 56, 61, 74 (FIG. 49); edges 56, 60, 74' (FIG. 50); edges 230, 236, 250 (FIG. 34); or edges 230, 236, 250' (FIG. 51)) provide an adjustable opening, rather than a static, fixed-dimension, fixed location "hole" or slit that limits the relative positions of the funnel 90 to the breast of the wearer. Still further, because the funnel 90 is supported by each of the multiple material layers or components in multiple directions or angles using the brassiere 10, 200 itself, the wearer may not need to hassle with separate attachment mechanisms or attachment devices such as hooks, buttons, zippers, hook-and-loop connections, or the like. Also, because the multiple material layers or components of the brassiere 10, 200 support the funnel 90 from multiple (e.g., three directions), this may decrease the likelihood that the funnel 90 will move away from the nipple undesirably during hands-free pumping. Additionally, the multiple material layers are configured to provide increased coverage of the breast when the brassiere of at least one embodiment disclosed herein is in a pumping configuration. The nooks 78, 252 may be configured to provide the minimal opening necessary to support the funnel 90. Accordingly, the brassiere and garments of at least one embodiment disclosed herein provides for a modest nursing garment.

Moreover, the configuration of the material layers with straight edges may provide for easier manufacturing and reduced production costs. Further, fabric from which the material layers of the brassiere cups are formed may be more efficiently and economically used, with less wasted material scraps, when the brassiere cups include a plurality of at least substantially straight edges compared to brassiere cups including curved edges.

While the exemplary embodiments illustrate garments incorporating two cups each configured for hands-free pumping, the invention is not limited to use in pairs, but may be used in a garment having one conventional cup, e.g., one cup not configured to receive the funnel of a breast pump. Further, in other embodiments, a nursing pad may be received between the first material layer and another of the layers or between the breast and the third material layer. Still further, while in the depicted embodiments, the first material layer is depicted as the top material layer, which directly partially overlaps the second material layer positioned as a middle material layer, which directly partially overlaps the third material layer positioned as the bottom material layer, in other embodiments the ordering of the material layers is reversed, as, for example, the first material layer partially overlapping the third material layer that partially overlaps the second material layer that rests against the breast. In others, the second material layer may be the innermost material layer or the outer-most material layer. Thus, while certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A garment for a nursing woman, the garment comprising a front brassiere portion, the brassiere portion comprising:

a plurality of at least partially overlapping material layers, the plurality of at least partially overlapping material layers comprising:

a first material layer extending from an upper peripheral edge of the front brassiere portion toward a lower peripheral edge of the front brassiere portion;

a second material layer extending from the lower peripheral edge of the front brassiere portion toward the upper peripheral edge of the front brassiere portion; and a third material layer extending from a lateral peripheral edge of the front brassiere portion toward a medial centerline of the front brassiere portion, the third material layer defining a free edge that is straight.

2. The garment of claim 1, wherein edges of each of the first material layer, the second material layer, and the third material layer define a substantially rectangular shape, the edges of the third material layer comprising the free edge that is straight.

3. The garment of claim 1, wherein:

the free edge of the third material layer extends vertically and parallel to the medial centerline of the front brassiere portion, and the second material layer comprises a free edge extending horizontally and parallel to the upper peripheral edge of the front brassiere portion.

4. The garment of claim 3, wherein the free edge of the second material layer and the free edge of the third material layer overlap to define a nook.

5. The garment of claim 4, wherein the first material layer overlaps the second material layer and the third material layer and conceals the nook.

6. The garment of claim 4, wherein the nook is substantially L-shaped.

7. The garment of claim 1, wherein the first material layer comprises a free edge extending horizontally and parallel to the lower peripheral edge of the front brassiere portion, the free edge of the first material layer being proximate to the lower peripheral edge of the front brassiere portion.

8. The garment of claim 1, wherein each of the first material layer, the second material layer, and the third material layer comprise a stretchable material.

9. A garment for a nursing woman, the garment comprising:

a pair of brassiere cups, wherein at least one brassiere cup of the pair comprises:

a first material layer at least partially overlapping a second material layer and a third material layer, the second material layer and the third material layer at least partially overlapping one another, a free edge of the second material layer crossing a free edge of the third material layer to define a nook, the free edge of the third material layer extending vertically from an upper peripheral edge of the brassiere cup to a lower peripheral edge of the brassiere cup, the free edge of the second material layer extending horizontally from a lateral side edge of the brassiere cup to a medial side edge of the brassiere cup, the first material layer overlapping the nook.

10. The garment of claim 9, wherein the nook is substantially V-shaped.

11. The garment of claim 9, wherein the nook is stretchably adjustable in size and position within the at least one brassiere cup.

12. The garment of claim 9, wherein the first material layer comprises a free edge extending horizontally from the lateral side edge of the brassiere cup to the medial side edge of the brassiere cup, the free edge of the first material layer being proximate to the lower peripheral edge of the brassiere cup.

13. The garment of claim 9, wherein the free edge of the third material layer is substantially straight and extends parallel to a medial centerline of the garment.

14. The garment of claim 13, wherein each of the free edge of the first material layer, the free edge of the second material layer, and the free edge of the third material layer is substantially straight.

15. The garment of claim 9, wherein the medial side edges of the brassiere cups of the pair at least partially overlap one another at a medial centerline of the garment.

16. A garment for a nursing woman, the garment comprising a brassiere portion comprising a pair of cups, at least one cup of the pair comprising at least partially overlapping material layers each having a periphery defined entirely by straight edges, at least two of the straight edges crossing to define a nook at a peripheral edge of the cup.

17. The garment of claim 16, further comprising a front overlay releasably attached to shoulder straps of the garment.

18. The garment of claim 17, wherein the front overlay is releasably attached to the shoulder straps of the garment by selectively releasable clasps.

19. The garment of claim 17, wherein the front overlay comprises an upper overlay portion and a lower overlay portion, the upper overlay portion extending a height of the brassiere portion, the lower overlay portion extending longitudinally downward, below a bust line of the garment, from the upper overlay portion.

20. The garment of claim 17, further comprising a back overlay attached to an upper peripheral edge of the brassiere portion along an upper peripheral edge of the back overlay.

* * * * *